US007690441B2

(12) United States Patent
Matsumoto et al.

(10) Patent No.: US 7,690,441 B2
(45) Date of Patent: Apr. 6, 2010

(54) BLADE DEVICE FOR WORKING MACHINE AND WORKING MACHINE MOUNTING BLADE DEVICE

(75) Inventors: Norihisa Matsumoto, Hirakata (JP); Tatsuo Wada, Hirakata (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 0 days.

(21) Appl. No.: 12/067,151

(22) PCT Filed: Sep. 5, 2006

(86) PCT No.: PCT/JP2006/317560

§ 371 (c)(1),
(2), (4) Date: Mar. 17, 2008

(87) PCT Pub. No.: WO2007/032230

PCT Pub. Date: Mar. 22, 2007

(65) Prior Publication Data

US 2009/0178817 A1 Jul. 16, 2009

(30) Foreign Application Priority Data

Sep. 15, 2005 (JP) ..... 2005-267787
Sep. 15, 2005 (JP) ..... 2005-269124

(51) Int. Cl.
*E02F 3/76* (2006.01)

(52) U.S. Cl. ..... 172/811; 37/266

(58) Field of Classification Search ..... 37/231–234, 37/206, 214, 266; 172/810, 811, 815; D15/10, D15/11, 23, 25, 32
See application file for complete search history.

(56) References Cited

U.S. PATENT DOCUMENTS

D477,610 S * 7/2003 Matsumoto et al. ..... D15/11
6,938,701 B2 * 9/2005 Matsumoto et al. ..... 172/811

FOREIGN PATENT DOCUMENTS

| | | |
|---|---|---|
| JP | 3-13356 | 2/1991 |
| JP | 4-92064 | 8/1992 |
| JP | 2757135 | 3/1998 |
| WO | 93/22512 A | 11/1993 |
| WO | 03/091504 A1 | 11/2003 |
| WO | 2004/044337 A1 | 5/2004 |

* cited by examiner

*Primary Examiner*—Robert E Pezzuto
(74) *Attorney, Agent, or Firm*—Fish & Richardson P.C.

(57) ABSTRACT

Concave front face surfaces of a blade device having ratios and configurations continuing from an upper end to a lower end of the blade device, and having a central face coupling front faces and end front faces on the right and left thereof.

9 Claims, 22 Drawing Sheets

BLADE DEVICE FOR WORKING MACHINE AND WORKING MACHINE MOUNTING BLADE DEVICE

CROSS-REFERENCE TO RELATED APPLICATIONS

This application is a 371(c) U.S. National Phase of PCT/JP2006/317560 filed on Sep. 5, 2006, which claims priority to Japanese patent application Nos. JP 2005-267787 filed Sep. 15, 2005 and JP 2005-269124 filed Sep. 15, 2005, the entire disclosures of which are herein incorporated by reference in their entireties.

TECHNICAL FIELD

The present invention relates to a blade device mounting mounted in various work machine such as a bulldozer and a loader, and more particularly, to a blade device for a working machine which is suitable for operations such as excavation, soil transportation and ground making, which has excellent working efficiency, and which realizes improvement of fuel efficiency and economic efficiency, and to a working machine for construction and earthmoving machinery having the blade device.

BACKGROUND ART

Various working machines such as a bulldozer and a loader are frequently used at various working sites such as construction sites and civil engineering sites. A blade, which is a work implement, is attached to the working machine of this kind. The blade is widely used for excavation, soil transportation, earth filling, piling and dozer working.

In order to exhibit the maximum operation efficiency in the working machine, it is important to increase the amount of soil to be transported as much as possible, to reduce the resistance in excavation and soil transportation as low as possible, and to adapt to different kinds of soil. If earth filling, soil piling and ground making can be carried out at the same time, this is preferable because the operation efficiency is remarkably improved. If optimal structure, shape, width and height of the blade, a position and excavation angle of a cutter (cutting edge) which satisfy these conditions are found, there are merits that the operation efficiency of the working machine is improved, fuel consumption amount is reduced, and the entire operation period can be shortened.

As one example of the blade device for increasing the operation amount of the working machine of this kind, the present applicant previously proposed Japanese Patent No. 2757135 (patent document 1). The patent document 1 discloses the blade device which can control the position of the blade attached to a front portion of a large-scale bulldozer in each of the excavation step, the soil transportation step and the soil discharging step. According to the blade device disclosed in this patent publication, a blade drive hydraulic device is controlled such that the blade is inclined backward (pitch back) with respect to the position at the time of excavation through a predetermined angle when soil is transported, and the blade is inclined forward (pitch dump) with respect to the position at the time of excavation through a predetermined angle when soil is discharged.

In order to exhibit the work capability of the bulldozer at a maximum, the balance of force in the soil transportation operation of the bulldozer is controlled such that the traction force is larger than soil transportation resistance and a driving force of the vehicle is larger than the traction force as described in the patent document 1. In the patent document 1, the traction force can be increased and the soil transportation resistance can be reduced by controlling the position of the blade as described above, and in order to increase the operation amount of the bulldozer, it is possible to largely increase the soil transportation amount without increasing the bulldozer in size, without increasing the engine output or without increasing the blade in capacity.

In the bulldozer, most of engine output required when the excavation and soil transportation operations are carried out is consumed by the driving force of the vehicle and the traction force at the time of the excavation and soil transportation. Therefore, it is important to reduce the loss in energy amount during power transmission and to improve the fuel efficiency. Further, it is strongly required to reduce the resistance during the excavation and soil transportation operations. Generally, in the case of a middle scale or a small scale bulldozer, a distance of soil transportation is shorter as compared with a large scale bulldozer. If the above-described requirements are satisfied, it is possible to effectively use the engine output during the excavation and soil transportation even with a traction force and a blade having the same volume as that of the conventional device.

Conventionally, in view of such circumstances, there is proposed a blade structure in which a first blade member is mounted on a lower end front portion of a machine body of an earthmoving vehicle, and second blade members are bent forward from both left and right ends of the first blade member as disclosed in Japanese Utility Mode Application Laid-open No. 4-92064 (patent document 2). The blade disclosed in the patent document 2 is called U-dozer and is used, a blade face is formed into various shapes such as an arc face having a constant curvature and a curved face having vertically different curvatures, but it is not concretely described that the horsepower consumption per a traction force in the excavation and soil transportation operations can be reduced and the fuel efficiency can be improved. There is no conventional technique which can effectively use the energy amount during the excavation and soil transportation and which can reduce the fuel consumption at the same time.

Hence, to solve such problems, the present applicant proposed a quite new blade structure in International Patent Application Laid-open No. 2004/044337 (patent document 3). The blade disclosed in the patent document 3 includes a central front face, coupling front faces extending from left and right ends of the central front face extending such that the coupling front faces are bent backward and spreading, and end front faces extending from the coupling front faces such that the end front faces are bent and spreading forward. A lower end of the central front face has a predetermined blade width extending laterally intersecting orthogonally with the excavation direction, the lower end has a first cutter, the coupling front faces and the end front faces are provided at their lower ends with second and third cutters. Cross lines of the coupling front faces and the end front faces and intersection between the tips of the second cutter and the third cutter are located at retracted position retracted from the tip of the first cutter as viewed from above. The central front face, the coupling front faces and the end front faces are respectively formed into concave curved faces which extend continuously from upper ends to lower ends thereof, and the central front face has such a special shape that its lower end has a small blade width and the blade width is gradually increased toward the upper end.

A working machine to which the blade of the patent document 3 is applied includes construction or earthmoving machinery, and representative examples thereof are construction or earthmoving vehicles such as a bulldozer, a wheel dozer and a motor grader. Expressions "as viewed from front" and "as viewed from above" of the blade device according to the present invention used in this specification means "as viewed from front" and "as viewed from above" when the blade comes into contact with the ground at a tip angle having high excavation efficiency, and "front" and "rear" means "front" on the side of a ground-contact face of the blade device and the other side is called rear. Further, "lateral direction" of the blade device is a direction intersecting orthogonally with the longitudinal direction as viewed from above.

The blade of the blade device includes a central front face constituting a portion of a blade front face, and left and right end front faces projecting from the left and right ends of the blade such as to spread forward as in the conventional semi-U type blade, but the blade of the present invention is largely different from the conventional blade in that coupling front faces are disposed between the central front face and the left and right end front faces, the left and right coupling front faces extend such as to bend at the left and right ends of the central front face such that the coupling front faces spread rearward, and the left and right end front faces extend from the rear end edges of the coupling front faces such that the end front faces spread in parallel to the extension of the lower end of the central front face or forward.

A blade which is different from that applied to various operations such as excavation, soil transportation and ground making but which has similar shape as that of the present invention is disclosed in International Patent Application Laid-open No. 93/22512 (patent document 4). The blade described in the patent document 4 is applied to a reclaiming compression working vehicle which compresses garbage while spreading the same at a waste dump. Like the conventional blade, this blade shape includes end blade portions projecting from left and right ends such as to spread in a form of wings in the running direction of the vehicle, one flat-plate like central blade portion connecting the left and right end blade portions with each other, and a rectangular box like projection which inclines downward from an intermediate portion of the central blade portion in the vertical direction such as to project in the running direction of the vehicle. Steel wheels are employed for a running device of the compression working vehicle, and garbage is compressed and processed by the wheels. The blade disclosed in the patent document 4 is developed with the emphasis on a function for dispersing garbage, and on a function in which a processing amount for compressing the garbage is controlled, and an amount of garbage to be sent to a space formed between left and right wheels which are the compressing members is limited so that a case where an excessively large amount of garbage enter the space and a lower face of the vehicle is damage is avoided. Therefore, the shape and functions of the blade of the patent document 4 are largely different from those of the blade of the patent document 3 having originally different function.

That is, (1) the central front face of the blade described in the patent document 3 deposits and holds a large amount of excavated earth and sand and thus, the central portion of the blade is continuous from the upper end to the lower end, but the central projecting portion of the blade in the patent document 4 corresponding to the central front face projects toward the lower end from the intermediate portion between the upper end lower ends of the central blade portion because a main purpose thereof is to eliminate excessive garbage, and (2) the intersection between the pair of left and right coupling front faces and the end front faces in the patent document 3 is located behind the central front face as viewed from above, and the tip ends of the end front faces extend to a location near the extension of the lower end edge of the central front face, but in the patent document 4, tip ends of the pair of left and right end blades projecting forward from the central blade portion are located in front of the projecting lower end edge of the central projection in any of the drawings although it is not described in sentences of the patent document 4. These differences are from the originally different functions of the blades disclosed in the patent documents 3 and 4 as described above.

Patent document 1: Japanese Patent Publication No. 2757135

Patent document 2: Japanese Utility Mode Laid-open Publication No. 4-92064

Patent document 3: International Patent Laid-open Publication No. 2004/044337

Patent document 4: International Patent Laid-open Publication No. 93/22512

DISCLOSURE OF THE INVENTION

Problem to be Solved by the Invention

According to the blade proposed in the patent document 3, a tip end of the third cutter of the end front face substantially matches with the extension of the lower end of the first cutter of the central front face or slightly retracted from the extension of the tip end of the third cutter as viewed from above. As a result, since the first cutter excavates earth and sand before the third cutter disposed at the lower end of the end front face, the excavation force by the central front face and the end front face is reduced and this facilitates the excavation. At the time of the excavation, however, the tip end of the third cutter projects slightly forward of the first cutter in some cases. In such a case, tip end of the third cutter excavates before the first cutter, but the projecting amount is extremely small, and the substantial excavation force as the entire third cutter of the end front face is extremely small as compared with the excavation force of the first cutter, there is no influence of the projection.

Therefore, according to the blade described in the patent document 3, the traction force applied to the third cutter is largely attenuated as compared with the conventional blade, resistance forces such as excavation resistance and soil transportation resistance are substantially evenly applied to the first cutter and the third cutter, the traction force is effectively applied to both the first cutter and third cutter, and soil excavated by the third cutter and soil excavated by the first cutter are smoothly merged with each other through the second cutter. Since the front face region of the intersection between the central front face and the end front face becomes a soil retaining portion, this region holds a large amount of transported soil efficiently.

The resistance force is reduced by the synergistic effect, and an amount of soil per a traction force can largely be increased. Further, the horsepower consumption during the excavation and soil transportation can largely be reduced, and the maximum excavation and soil transportation amount can be obtained with the minimum energy amount within a short time. It is possible to remarkably improve the fuel efficiency of the working machine and to reduce the cost per an earthwork quantity.

The blade device described in the patent document 3 exhibits remarkably excellent effect due to its special structure which cannot be expected by the conventional blade, but the central front face, the coupling front faces and the end front faces might be inferior in terms of excavation efficiency although the number thereof is smaller as compared with the conventional semi-U type blade having the same blade width. At the time of turning, pushing and rotation at the time of soil transportation, a case in which soil accumulated on the blade within a short time during turning and running slips and drops onto the outside coupling front face from the central front face, and the soil instantaneously flows and drops from the end front face occurred.

In the case of a large scale blade of this kind, even if the blade is small in size, the blade is prone to be larger in size and heavier in weight unlike a normal part. Hence, sheet metal is generally used to reduce the blade in weight. However, it is impossible to obtain a desired shape by a press machine from a piece of sheet metal. Therefore, the shape and structure of the blade described in the patent document 3 are complicated, and when the position of the cutter at the time of the excavation and soil transportation is taken into account, the blade must usually be assembled by welding of a welding robot, but in this case, the welding robot is required to have complicated and high performance motion. Therefore, sufficient treatment is required from software and hardware, it is difficult to develop an ideal welding at an early stage, and this largely increases costs.

The present invention has been accomplished in view of such circumstances, and it is a main object of the invention to provide a blade device for a working machine capable of reducing the resistance force of the patent document 3, capable of largely increasing the amount of soil per a traction force, capable of largely reducing the horsepower consumption during the excavation and soil transportation, capable of obtaining the maximum excavation and soil transportation with the minimum energy amount within a short time, capable of obtaining the excavation efficiency which reliably exceeds that of the conventional semi-U type blade, without dropping soil when turning, pushing and rotating motion during the soil transportation. A second main object of the invention is to provide a blade device for various working machines proposed by the patent document 3, and more particularly, various blade devices for working machines capable of in construction or earthmoving machinery in severe environment where high load is applied, capable of easily obtaining desired shaped having short longitudinal size, capable of securing desired rigidity and strength although its weight is light, and capable of easily forming a smooth curved face which cannot be obtained by welding. Other objects will become apparent from the later-described best aspect of the invention.

Means for Solving the Problems

The above object is effectively achieved by a basic structure of a first invention of the application, i.e., a blade device mounted on various working machines, wherein a blade includes a central front face, and end front faces continuously provided through coupling front faces which are bent and continuously provided on left and right ends of the central front face, a lower end of the central front face has a blade width W1 which intersects orthogonally with an excavation direction and extends laterally, and the central front face is provided at its lower end with a first cutter, the coupling front faces and the end front faces are provided at their lower ends with second and third cutters, a cross line between each of the coupling front faces and each of the end front faces and an intersection of each tip of the second and third cutters are located rearward of a tip of the first cutter as viewed from above, respective front faces of the central front face, the coupling front faces and the end front faces are concavely curved faces which are continuous from upper ends to lower ends, and when the blade width of the central front face is defined as W1, a distance between an extension of the first cutter and the intersection of each tip of the second and third cutters is defined as Wt, and a backward-bending angle between the tip of the first cutter and the second cutter is defined as δ, the distance Wt and the backward-bending angle δ simultaneously satisfy following expressions (I) and (II):

$$Wt>0.65\times(W1/10) \quad \text{(I)}$$

$$14°<\delta<30° \quad \text{(II)},$$

wherein Wt and W1 may be actual values (mm) or reference values (no unit). In this invention, it is further preferable that a crossing angle θ between extensions of each cutter of the central front face and each of the end front faces is set within a range of $0°<\theta\leqq 25°$.

In this way, preferably, the left and right coupling front faces are provided so as to spread in a range of the backward-bending angle δ rearward continuously from the central front face as viewed from above, and the left and right end front faces are provided so as to spread with the crossing angle θ forward continuously from the coupling front face as viewed from above. That is, each coupling front face and each end front face are connected to each other in a V-shape or U-shape, and further, each second cutter and each third cutter are connected to each other in a V-shape or U-shape.

One of characteristic structure of the invention is how the shortest distance Wt and the backward-bending angle δ should be determined. Thus, all of the blade may be made of sheet metal or a molded body may be combined as a portion thereof. When the molded body is used, according to a preferred aspect of the invention, at least all of the coupling front faces and end front faces are included, a pair of left and right integral molded portions including connection side regions of the central front face, and a main region of at least the central front face are included, and a sheet metal portion having connection end faces to be coupled to the connection side end faces of the integral molded portions is included. When the molded body is combined as a portion of the blade, it is preferable that the connection line between the molded body and the sheet metal is located on the horizontal line or vertical line as viewed from front. Left and right lift frames and brackets which pivotally support ends of various hydraulic cylinders should be integrally molded on the back face portion of the molded body.

In the invention, it is preferable that at least the first cutter of the central front face is substantially equal to the blade width W1 of the lower end of the central front face, and the central front face is a curved face which is concave rearward toward the upper end from the lower end and is gradually increased in width. The blade width W1 of the lower end of the central front face is preferably larger than an inner width between the left and right driving devices, and the blade width W1 of the lower end of the central front face is preferably substantially equal to a gage width which is a distance between centers of the left and right driving devices.

It is preferable that the second cutter is inclined slightly downwardly in the lateral direction with respect to the first cutter, and the third cutter is slightly inclined upward in the lateral direction with respect to the second cutter. A sidewall body projecting in the excavation direction from the outer end face of each of the end front faces is preferably provided. The retraction angle γ of the respective cutters of the coupling front face, the coupling front faces, and the end front faces is set to 0° or larger and 15° or smaller. It is preferable that the front faces of the blades of the coupling front faces and the end front faces have the same curved faces as that of the central face.

The above object is achieved by a basic structure of a second invention of the application, i.e., a blade device for earthwork mounted on various working machines, wherein a blade includes a central front face, coupling front faces which are continuously provided so as to be bent from left and right ends of the central front face rearward in an excavation direction, and left and right end front faces further continuously provided on the coupling front faces so as to project in parallel to or forward of an extension of the central front face, a lower end of the central front face has a blade width W1 which intersects orthogonally with the excavation direction and extends laterally, and the central front face is further provided at its lower end with a first cutter, the coupling front faces and the end front faces are provided at their lower ends with second and third cutters having blade widths W2 and W3, a cross line between each of the coupling front faces and each of the end front faces is located inside a pair of left and right bracket devices in a lateral direction as viewed from above of the blade device, the bracket devices being provided on a back face of the blade device as mounting portions of lift frames for connecting to the working machine, and a value of a ratio (W3/W2) of the blade width W3 of each of the third cutters to the blade width W2 of each of the second cutters is set larger than 0.5 and smaller than 2. More preferably, the value of the ratio (W3/W2) is 0.7 or larger and 1.3 or smaller.

In this invention, it is preferable that the blade width W1 of the lower end of the central front face is 0.4 to 0.9 times of a length between the pair of left and right bracket devices, and a backward-bending angle δ of each cutter of the central front face and each of the coupling front faces is set 14° or larger and 30° or smaller as well as the first invention. In this invention, all of the blade may be made of sheet metal or molded body, and a combination of the sheet metal and molded body may be employed. In the latter case, it is preferable that a connecting line between end faces of the molded body and the sheet metal is in a horizontal straight line or a vertical line as viewed from front.

The blade device can be mounted on various working machines.

EFFECT OF THE INVENTION

The outer appearance of the soil transportation on the blade of the present invention has such a shape that a central portion thereof largely swells forward beyond the angle of rest from the upper end to the lower end of the central front face as in the blade disclosed in the patent document 3. The outer appearance of the soil transportation of the conventional blade has such a straight flat face shape having an inclination angle substantially equal to the angle of rest from the upper end to the lower end of the blade. That is, according to the present invention, as in the patent document 3, it is possible to obtain the maximum excavation and soil transportation amount with the minimum energy amount in a short time, the fuel efficiency of the working machine is largely improved and cost per earthwork quantity is reduced.

After the proposal of the blade disclosed in the patent document 3 was made, various tests were repeated and the above-described problems were found. Hence, various tests and designs were repeated, and the inventors found that the excavation efficiency was varied and soil dropped from the blade at the time of turning while pushing soil because indices for objectively determining optimal shapes of the central front face, the coupling front faces and the end front faces suitable for the blade capacity (standard work quantity per one motion of a blade to push earth and sand which is a value calculated by SAE standard J1265MAR88), and a relative rate of blade widths of the front faces are not established.

As results of the tests, it was found that the excavation efficiency of the blade device according to the present invention having the above-described entire structure was determined by three parameters, i.e., a blade width W1 of the central front face, a distance (retraction amount, hereinafter) Wt between the intersection between the tip of the central front face and the tip of the end front face, and the bending angle δ of the tip of the second cutter of the coupling front face which bends rearward with respect to the tip of the first cutter of the central front face. The expressions (I) and (II) of the first invention are correlation expressions of these three parameters. Further, the backward-bending angle δ has an upper bound value and a lower bound value, the lower bound value prescribes the lower bound value (%) of the excavation efficiency, and becomes a lower bound value for reliably exceeding the excavation efficiency of the semi-U type blade. On the other hand, the upper bound value of the backward-bending angle δ is a value for reliably preventing the soil drop caused by turning while pushing during the soil transportation.

When a value of the retraction amount Wt suitable for the blade volume is determined, the value of the optimal backward-bending angle δ suitable for the blade volume can be selected from the numeric value range. Generally, the blade width W1 of the central front face is preferably set substantially equal to a distance (gage width) between center lines of the left and right driving device of the working vehicle. The entire width W of the blade is determined uniquely by the blade capacity, and the blade width W1 of the central front face which is equal to the gage width WG is also determined in the same manner. The entire blade width W, the gage width WG and the blade width W1 are lengths which are varied by the automobile rank and the blade capacity. For example, if the entire blade width W having the blade capacity of 10 $m^3$ is defined as a reference, the actual entire blade width of the central front face when it is smaller than 10 $m^3$ becomes shorter than the blade width W, and when it is larger than 10 $m^3$, the actual blade width of the central front face becomes longer than the blade width W. The value Wt of the retraction amount to the intersection between the tips of the coupling front face and the end front face with respect to the tip of the central front face is determined by multiplying the actual blade width W1 obtained in this manner by 0.65/10 which is a constant obtained by the test. If the retraction amount Wt is determined, a backward-bending angle δ, which is most excellent in excavation efficiency and which can stand up to the turning while pushing, is selected from the backward-bending angle δ by the correlation diagram. With this, since the entire width W of the blade is determined, a size W4 between the lower end bending point between the central front face and the coupling front face and the outer end face of the end front face is necessarily determined.

However, the intersection angle θ between the extension of the tip of the central front face and the extension of the tip of the end front face is not determined yet. Since the crossing angle θ forms a soil retaining portion formed on a front face of bending portions of the coupling front face and the end front face, the crossing angle θ has extremely important significance together with the backward-bending angle δ. Further, this exerts influence on magnitude of the excavation force of the end front face which is varied by soil property of the working site. The crossing angle θ(°) between the coupling front face and the end front face in the soil retaining portion can be calculated by 180°−(δ+θ). To maintain the holding of soil, it is preferable that θ is as large as possible. When the soil property at the site is soft and only the ground making function suffices, θ is brought closer to 0° as much as possible. On the other hand, if the soil property is hard and side cut function is necessary, it is necessary to increase the value of θ to some extent. Therefore, the value of θ is not determined uniquely, but it can be determined while taking the backward-bending angle δ into account in accordance with function required for the end front face. However, it is said the maximum value thereof is about 250 to ensure the side cutting function.

Furthermore, it is preferable that the crossing angle θ at which the extensions of the cutters of the central front face and the end front face intersect with each other is set to a value larger than 0° and smaller than 30°. When the soil property at the site is soft and only the ground making function suffices, θ is brought closer to 0° as much as possible. On the other hand, if the soil property is hard and the side cutting function is required, it is necessary to increase the value of θ to some extent. Therefore, the value of θ should be determined in accordance with a function required for the end front face, and the range should be set within a range larger than 0° and smaller than 30°. If the crossing angle θ exceeds 30°, a load of tip of the third cutter of the end front face is concentrated, excessive load is applied at the time of excavation, a load is not applied to the entire cutter evenly, and the tip may be broken. As described above, the blade device of the present invention also has the ground making function in many cases. Hence, the crossing angle is brought closer to 0° as much as possible in some cases. The end position of the end front face is located in front of the extension of the central front face in some cases depending upon the determining manner of the lengths of the cutters, the backward-bending angle δ, and the crossing angle θ, but if this is very slight, this does not substantially exert influence on the excavation force as described above.

Since the entire blade width of blade device is determined by the entire blade capacity and the blade width W1 of the lower end of the central front face is substantially determined by the size between the center lines of the left and right driving devices, the excavation efficiency of the blade device is varied depending upon how the blade width of the second cutter of the remaining coupling front face and the blade width of the third cutter of the end front face are determined.

The coupling front face rearwardly extending from the left and right ends of the central front face and the end front faces extending in parallel to the extension of the lower end of the central front face from the rear ends of the left and right coupling front face or extending forward in the excavation direction have a function for holding soil excavated by the coupling front faces and the end front faces, carrying the soil upward, and flowing and depositing the soil on the central front face through the bent faces of the coupling front face and the central front face. When the end front face is in parallel to the extension of the lower end of the central front face, this is a special function and preferable for ground making, and the main function is the side, and has a function for preventing the soil held between the coupling front faces from dropping from side.

The relative blade width of the cutter with respect to the second cutter of the connection front end and the third cutter of the end front face is determined depending upon which function is the most important. At that time, the relative size of the blade width exerts influence also on the rear end crossing angle of the coupling front face and the end front face. Therefore, the blade widths of the second cutter and the third cutter cannot be determined uniquely. Under such circumstances, the inventors repeated various tests concerning relative sizes of the second cutter and the third cutter which can most contribute to the stabilization of the excavation efficiency and securing of a desired holding amount. As a result, the inventors found that the excavation efficiency can be stabilized and the desired holding amount can be secured when the ratio (W3/W2) of the blade width W3 of the third cutter to the blade width W2 of the second cutter is in the range of 0.5 to 2. If the value of this ratio is 0.5 or less, the dropping amount of soil from side is increased and as a result, the holding amount is reduced. If the value is 2 or more, the excavation amount is increased but the held soil cannot be carried to the central front face smoothly and as a result, the depositing amount of soil on the central front face is reduced. More effective ratio (W3/W2) is 0.7 or more and 1.3 or less.

Further, blade width W1 of the lower end of the central front face is preferably 0.4 to 0.9 times longer than the length between the pair of left and right bracket devices as the lift frame mounting portion for connecting the working machine to the back face of the blade device, the backward-bending angle of the cutters of the central front face and the coupling front face is preferably larger than 14° and smaller than 30°. If the blade width W1 is set to the above-described value, the excavation and soil transportation force can be transmitted to the working machine efficiently through the lift frame connected to the bracket device. By the setting of the backward-bending angle of the cutters of the central front face and the coupling front face, efficiency of the excavation force of the central front face is improved and more soil can be held together.

The blade width of the central front face must be increased in order to reduce the widths occupied by the coupling front face and the end front face, the resistance forces such as the excavation resistance and the soil transportation resistance, and to largely increase the soil transportation amount. To secure a desired length along the lower ends of the coupling front face and the end front face, the intersection angle between the coupling front face and the end front face as viewed from above must be reduced. As a result, the distance between the position of the cutter of the central front face and the support point of the lift frame, which supports the blade, must be increased.

If the distance between the position of the cutter of the central front face and the support point of the lift frame which supports the blade is increased, the influence of the uneven face of the ground surface at the time of excavation is largely received, pitching motion of the vehicle is prone to be generated in front and behind, the blade is largely swung vertically, excavation by the central front face cannot be carried out stably, the excavation surface is prone to be uneven, and the ground cannot evenly be flattened. When they are taken into account, it is necessary to determine the blade width of the central front face while taking the blade widths of the coupling front face and the end front face into account. In this invention, it is preferable that the blade width of the central front face is substantially equal to the gage width which is the distance between the centers of the left and right driving devices, and the value of W1 is in a range of 0.6 to 0.7 of the length between the pair of left and right brackets as the mounting portion of the lift frame. If the effective excavation force per a blade width of the first cutter of the central front face is increased and efficient excavation and soil transportation can be carried out, the ground can evenly be leveled.

The coupling front face smoothly merges the soil moved from both the end front face and the central front face a the time of the excavation and soil transportation, and raises up and holds the soil along the front faces of the blades of the coupling front face and the end front face. Therefore, the loss of the soil amount can be reduced, the resistance of soil, which tries to flow toward the central front face from the end front face, can be reduced, and the amount of soil deposited on the blade front face of the central front face can largely be increased as described above.

All of the blades of the blade device of the present invention are made of sheet metal, and the blade can be assembled by welding. If the easiness of the welding is taken into account, a portion of the central front face and the coupling front face and the end front face are integrally molded together with the back face support portion, thereby securing necessary rigidity and strength with the minimum depth, a back support member which is mainly made of sheet metal is disposed on a sheet metal portion, and a back support member which is integrally molded with a reinforcing rib is disposed on a portion of the back support member if necessary. With this structure, a smooth face can be obtained even on the curved portion and the bent portion, necessary rigidity and strength can be secured, and a blade device having minimum volume and weight can be obtained. Further, if the welding portions for welding the end faces of the central front face and the coupling front face are formed straightly as viewed from front, the robot welding can easily be employed, the producing cost can be reduced and the producing time can largely be reduced.

The blade of the invention has the special shape having the bending face in the lateral direction and the curved face in the vertical direction as described above. The blade can integrally be molded including all of the bending regions, and it is formed with a piece of sheet metal which has a necessary curved face only in a main region of the central front face. When both the left and right ends of the central front face from the lower end to the upper end are increased in width upward together with the curved face, the boundary line between the left and right ends including the back support portion and the coupling front face is necessarily bent in the vertical direction, and the left and right bending angle is increased in the vertical direction and complicated and thus, it is preferable to avoid the welding at the boundary line region. When the blade has the complicated shape and structure as in the present invention, the connection boundary line between the sheet metal portion and the molding body portion is a vertical line as viewed from front. A reversed triangular region of both ends extending laterally from the upper end edge of the central blade portion is divided along the vertical line, the divided ends are moved to the integrally molded portion, and the coupling front face and the end front face are integrally molded as an integral molded portion. A central main region of the central front face has a simple rectangular shape as viewed from front, this region can easily be bent as the sheet metal, butted end faces of the central front face and the divided end of the integrally molded portion can easily be welded to each other.

One ends of left and right lift frames are pivotally supported by a body of the working machine and the other ends are pivotally connected to a bracket, and the bracket is integrally molded on the back support portion of the integrally molded portion. With this, it becomes unnecessary to weld the bracket to the back support portion unlike the conventional technique, and necessary strength of the bracket can easily be obtained. At that time, if a solid structure which is continuous between the bracket and the back support portion provided with the bracket is molded and other back support portion is formed into a solid structure, necessary rigidity and strength can easily be secured, and the weight can be reduced at the same time. In the present invention, if the entire width W of the blade of each of the central front face, the coupling front face and the end front face is set to 2.3 to 3.0 times of the inner width WO of the working machine body as viewed from above, the longitudinal and lateral balances of the entire working machine at the time of the excavation and soil transportation are improved, the operability of the entire working machine is improved and as a result, the excavation performance can sufficiently be exhibited, and fuel waste can be reduced.

Further, according to the preferred aspect, a portion of the central front face and the coupling front face and the end front face are integrally molded together with the back support portion, necessary rigidity and strength are secured with the minimum depth, the back support member made of sheet metal is disposed on the sheet metal portion, if needed, a back support member which is integrally molded with a reinforcing rib may be disposed in a portion thereof.

Generally, as main operations of the working machine are excavation, soil transportation and ground making, and it is important that these machines have a blade having a function capable of carrying out different operations. The blade of the invention has excavation function, the soil transportation function and ground making function. Usually, the ground making operation of this kind requires two points, i.e., leveling the ground while excavating the ground, carrying soil forward, and filling the hole along the way, and evenly leveling the ground. In the present invention, if the blade width of the central front face is increased, the so-called leveling function is increased. In the invention, the central front face project forward than the coupling front face and the end front face as viewed from above in many cases. The coupling front face and the end front face of the invention also have the ground making function, but most of this function depends on the central front face. Hence, in the present invention also, like the blade device disclosed in the patent document 3, it is possible to widen the blade width of the central front face.

The patent document 3 is characterized in that the tip end of the third cutter of the end front face is located behind the extension of the lower end of the central front face as viewed from above, but in the present invention, it is prescribed that the cross line between the coupling front face and the end front face and the intersection between the tips of the second and third cutters are located behind the tip of the first cutter of the central front face as viewed from above. Therefore, in the present invention, the tip end of the third cutter of the end front face may not exist behind the extension of the first cutter of the central front face and the tip end may project forward of the extension. This is because that when the invention is carried out, the tip end of the third cutter may project slightly forward of the first cutter in some cases due to circumstances of design. In such a case, the tip end of the third cutter excavates the ground before the first cutter excavates, but since the projecting amount is extremely small, the substantial excavation force of the entire third cutter of the end front face is smaller than the excavation force of the first cutter, and the projection does not affect thereto.

Therefore, in the present invention, as long as the tip end of the third cutter of the end front face is disposed near on the extension of the tip of the first cutter, like the blade of the patent document 3, the first cutter excavates earth and sand substantially simultaneously with the third cutter, soil excavated by the cutter of the end front face and soil excavated by the first cutter of the central front face merge with each other through the coupling front face, and the soil transportation amount can largely be increased. In the invention, as the blade width of the central front face is increased, the widths of the coupling front face and the end front face as viewed from above must be reduced.

To reduce the widths of the coupling front face and the end front face, to reduce the resistance force such as the excavation resistance and soil transportation resistance and to largely increase the soil transportation amount, it is preferable that the length along the lower ends of the coupling front face and the end front face is constant. That is, in order to increase the blade width of the central front face and to secure a necessary length along the lower ends of the coupling front face and the end front face, it is necessary to reduce the intersection angle between the coupling front face and the end front face as viewed from above. As a result, a distance between the cutter position of the central front face and the support point of the blade back face of the straight frame which supports the blade must be increased necessarily. In other words, the depth of the blade is increased.

If the distance between the cutter position of the central front face and the support point of the straight frame which supports the blade is increased, influence of uneven face of the ground at the time of excavation is received, the pitching motion of the vehicle is prone to occur in front and behind the vehicle and as a result, the blade largely swings vertically, excavation cannot be carried out stably by the central front face, the excavated face is prone to become uneven, and leveling cannot be carried out evenly. If these facts are taken into account, it is necessary to determine the blade width of the central front face as viewed from above while taking the blade widths of the coupling front face and the end front face into account. In this invention, if the blade width of the central front face is set substantially equal to the gage width which is the distance between the centers of the left and right driving devices, the effective excavation force per a blade width of the first cutter of the central front face is increased, the excavation and soil transportation can be carried out efficiency, and the ground can be leveled evenly.

If the internationally laid-opened blade in the patent document 4 is taken into account, it can be understood that the structure is largely different from that of the present invention in this point also. That is, in the blade disclosed in the above publication, the effective width of the central projection is substantially equal to the distance between the left and right wheels which are the compression devices, i.e., the distance between opposite faces of the left and right wheels. This is a natural structure because the function of the central projection is to prevent a large amount of garbage entering the space formed between the left and right wheels.

As one preferable embodiment of the blade of the present invention, the left and right coupling front faces are opened at a predetermined angle rearward continuously with the central front face, the coupling front faces are provided with their lower ends with second cutters, the left and right end front faces are opened at a predetermined angle forward continuously with the coupling front faces, and the end front faces are provided at their lower ends with the third cutters.

It is possible to employ a shape in which the second cutter and the third cutter are continuous in a V-shape or U-shape. Especially in the case of soil property having high viscosity, if the second cutter and third cutter are connected in the form of the V-shape, excavated soil adheres to the switching portion between the coupling front face and the end front face and in clusters in many cases and thus, the switching region is formed into the curved face such as U-shape.

It is preferable that the coupling front face and the end front face are continuous with each other in the form of the V-shape or U-shape like the second cutter and the third cutter and at the same time, the coupling front face and the end front face are bent rearward with respect to the central front face. With this, the device has a function for reliably holding soil during excavation and soil transportation so that soil does not flow outside from the side end of the blade. Especially the coupling front face allows soil moved from the end front face and soil moved from the central front face to merge with each other smoothly, raises up and holds the soil along the front faces of the blades of the coupling front face and the end front face. Thus, it is possible to reduce the lose of soil amount, reduce the resistance of soil which tries to flow toward the central front face from the end front face, and to largely increase the amount of soil deposited on the blade front face of the central front face as described above.

In the case of the self-propelled working machine of this kind, an engine compartment is disposed at a central portion of a front portion of the vehicle body in many cases, and an operator operates various control levers at the rear of the engine compartment. Thus, the operator's sight is blocked by the engine compartment, and the operator cannot directly visually check the amount of excavated soil deposited on the central front face of the blade.

In this invention also, with the position of the blade in which the maximum excavation performance is exhibited, when tips of the cutters of the central front face, the left and right coupling front faces and the left and right end front faces when the blade comes into contact with the ground with an excavation angle as viewed from front are arranged on the same straight line, it is only possible to check the amount of soil deposited between the coupling front face and the end front face which are disposed laterally. The amount of soil deposited on the central front face increases the amount of soil deposited on the central front face because the amount of soil deposited between the coupling front face and the end front face is added. When it becomes possible to for the operator to check the amount of soil deposited between the coupling front face and the end front face from above, the amount of soil deposited on the central front face exceeds a predetermined amount in many cases, the complicated degree of the blade operation is increased.

Hence, according to the preferred aspect of the present invention, with the position of the blade in which the maximum excavation performance is exhibited, the left and right second cutters are slightly inclined downward with respect to the central first cutter as viewed from front when the blade comes into contact with the ground with a tip excavation angle, and the third cutter is upwardly inclined slightly with respect to the second cutter.

If such a structure is employed, the switching portion between the second cutter and the third cutter enters the ground with a normal position, and excavation amount larger than the conventional amount is obtained between the second cutter and the third cutter at the time of excavation. With this, the amount of soil deposited between the coupling front face and the end front face is increased, and this amount follows the amount of soil deposited on the central front face. As a result, even if the operator cannot visually check the amount of soil deposited on the central front face, if the operator visually checks the amount of soil deposited between the left and right central front faces and end front faces, it is possible to grasp the appropriate amount of soil deposited on the central front face, and it is possible to smoothly operate the blade.

The blade of the invention can be formed in such a manner that the central front face, the coupling front face and the end front face are independently formed and the front faces are continuously formed by welding them with each other, but if the size and the thickness of the blade are appropriately set, the front faces can integrally be formed by molding as described above. Further, the invention may have left and right walls extending in the excavation direction from the outer end face of the end front face beyond the left and right end edges. In this case, the strength and rigidity of the left and right ends can be improved together with the support body of the back portion, and it is possible to effectively exhibit the function for reliably holding soil during the excavation and soil transportation of the front face of the blade with a simple structure.

In the invention, the width of the cutter of the lower end of the end front face is relatively determined between this width and the width of the cutter of the coupling front face and thus, it is difficult to uniquely determine this width, but this width is smaller than the width of the cutter of the lower end of the central front face, and it is preferable that this width is set to substantially equal to the width of the cutter of the lower end of the coupling front face. If the widths of the front faces are set in the size relation, it is possible to optimize the amount of soil which is raised and held along the front faces of the blades of the coupling front face and the end front face, and this is preferable because the resistance of soil with respect to the central front face can be reduced. However, if the excavation efficiency is taken into account, the retraction amount Wt to the intersection between the second cutter of the coupling front face and the third cutter of the end front face, and the rearward bending angle δ between the first cutter of the central front face and the second cutter of the coupling front face are limited and thus, a difference must be provided between the blade widths of the coupling front face and the end front face in many cases.

In the invention, the blade front faces of the central front face, the coupling front face and the end front face may be inclined rearward than the front faces of the cutters like the general cutter, but if they are excessively inclined rearward, the amount of soil dropping from back on the blade is increased when soil is discharged. Therefore, it is conceived that front faces of the cutters are provided on the extension of the front face of the lower end of the blade, and the rear inclination position stands up. If the entire blade is inclined rearward and if the inclination angle, i.e., the angle of rest of the front face of the deposited soil held by the blade is made constant, the ground contact length with respect to the ground of soil deposited on the ground can be reduced, and a large amount of soil can be loaded on the front face of the blade. When the front face of each cutter is provided on the extension of the front face of the lower end of the blade also, it is necessary to rearwardly incline the entire curved face of the blade itself. As a result, the soil transportation resistance can largely be reduced, and it is possible to largely reduce the horsepower consumption per a traction force, and excellent low-fuel 1 consumption can be obtained.

It is preferable that a retraction angle which is a difference between a tip angle formed between the ground and the front face of each cutter and an angle (excavation angle) between the ground surface and the extension of the lower end face of the blade of the front face is set within a range between 0° or more and 15° or less. If the retraction angle is set to 0° or more, the holding amount of soil by the blade can be increased. If the retraction angle exceeds 15°, there is a possibility that it becomes difficult to discharge soil held by the blade. If the cutter is provided on the extension of the front face of the blade, i.e., if the retraction angle is set to 0°, the radius of curvature of the curved face in the vertical direction of the front face of the blade is increased as compared with the conventional technique. If such a curved face is formed, slide down of the soil transportation at the time of soil discharge becomes smooth without changing the excavation efficiency at the time of excavation, and the large amount of soil can be loaded on the front face of the blade. According to the present invention, since the large amount of soil can be loaded on the front face of the blade of the front face, excellent balance of the ground contact pressure in the front and rear of the vehicle body can be obtained, power loss such as shoe slip is small, and high traction force can be obtained. It is possible to prevent soil deposited on the front face of the blade of each front face from overflowing out rearward beyond the upper end of the front face.

In the invention, the crossing angle at which the central front face and the end front face intersect with each other on the extension of the cutters is set to 0° to 25°. Especially when the side cutting function is important, it is preferable that the crossing angle is set within a range of 18° to 25°. If the crossing angle is in the range of 18° to 25°, it is possible to secure the optimal soil amount to be loaded on front faces of the blades of the coupling front face and the end front face, the resistance of soil moving from the end front face to the coupling front face can be reduced, and if the crossing angle is smaller than 18°, the side cut function is lost. As described above, the function of the end front face is not limited to the side cut function, and when it is necessary that the third cutter of the end front face has the ground making function, the crossing angle δ may be reduced closer to 0° as much as possible. In the present invention, if the tip angle between the front face and the ground surface when the tips of the cutters are on the ground is set to 40° to 55°, the minimum excavation and soil transportation energy amount and the maximum soil amount can effectively be obtained.

EXPLANATION OF SYMBOLS

Figure 1:
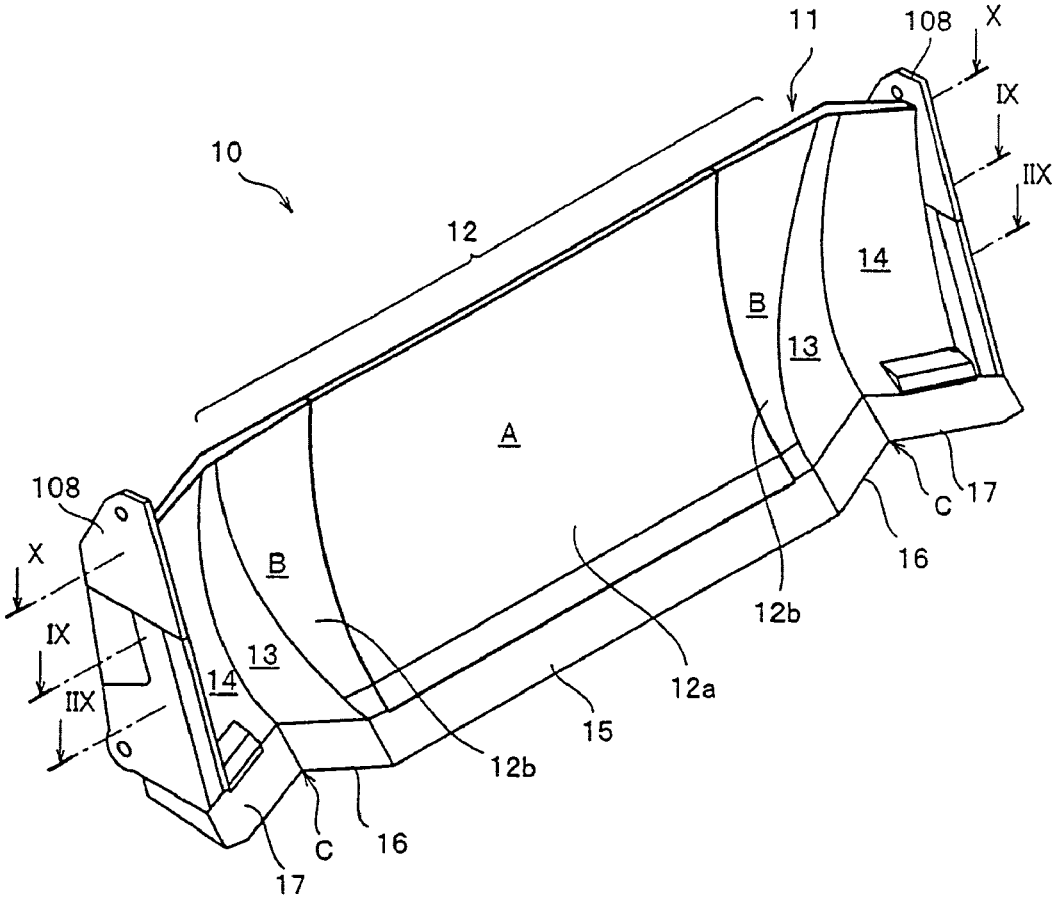
FIG. 1 is a perspective view showing an entire schematic structure of a representative blade device to which the present invention is applied as viewed from front.

1 bulldozer
2 track-type driving device
3 lift frame
4 (hydraulic) tilt cylinder
5 engine compartment
6 (hydraulic) lift cylinder
7 strut arm
10 blade device
11 blade
12 central front face
12*a* (rectangular) divided central portion
12*b* (triangular) divided end
13 coupling front face
14 end front face
15 to 17 first to third cutters
18 upper end sheet metal material
18*a* lattice
25*a* to 25*d* first to fourth brackets
26 vertical plate rib
101 integrally molded portion
102 front face plate
103 back face portion
103*a*, 103*b* first and second back support portions
105 sheet metal portion
106 front face plate
107 back support member
107*a* to 107*d* first to fourth back support members
107*d*-1 to 107*d*-3 divided members
107*d*-1' to 107*d*-3' reinforcing ribs
α tip angle
β excavation angle
γ retraction angle
δ backward-bending angle
θ crossing angle
C intersection
Wt (intersection C) retraction amount
W entire width of blade
W1 lower end blade width of central front face (=gage width WG)
H blade height when tip angle is α

BEST MODE FOR CARRYING OUT THE INVENTION

Preferred embodiments of the present invention will be explained concretely based on the accompanying drawings below. A blade device of the invention can be used as a work implement mounted on various work machines. Examples of the work machine to which the invention is applied are construction and earthmoving machineries. Although a bulldozer (not shown) will be explained as an example of the construction and earthmoving machineries in the embodiment, the present invention is not limited to this, and construction and earthmoving machineries such as an excavator, a backhoe and a motor grader are included.

As shown in FIGS. 1 to 5, the representative blade device 10 of the invention includes a blade 11 which is curved vertically in the concave shape. The embodiment has a monoblock casting structure as a portion which is one of preferred aspect, and a sheetmetal forming structure is employed for other portion. The invention necessarily includes a case in which the entire blade is made of sheet metal as proposed in the patent document 3.

A front face of the blade device 10 of the invention is based on a basic shape of a blade device front face disclosed in the patent document 3 and thus, the concrete effect based on the basic shape is the same as the effect described in the patent document 3. Therefore, explanation of the effects is described only briefly, and structure and effect peculiar to the present invention will be explained in detail. The blade 11 of the blade device 10 of the invention has a basic structure shown in FIG. 1. That is, the front face of the blade 11 is vertically curved in the concave manner. The blade 11 includes a central front face 12 provided at its lower end with a straight first cutter 15, a pair of left and right coupling front faces 13 having second cutters 16 extending continuously from the first cutter 15 at a predetermined backward-bending angle δ such as to spread, and a pair of left and right end front faces 14 having straight third cutters 17 extending forward such as to spread at a predetermined crossing angle θ with respect to the extension of the first cutter 15. The end front faces 14 are continuously coupled to outer ends of the second cutters 16.

Figure 5:
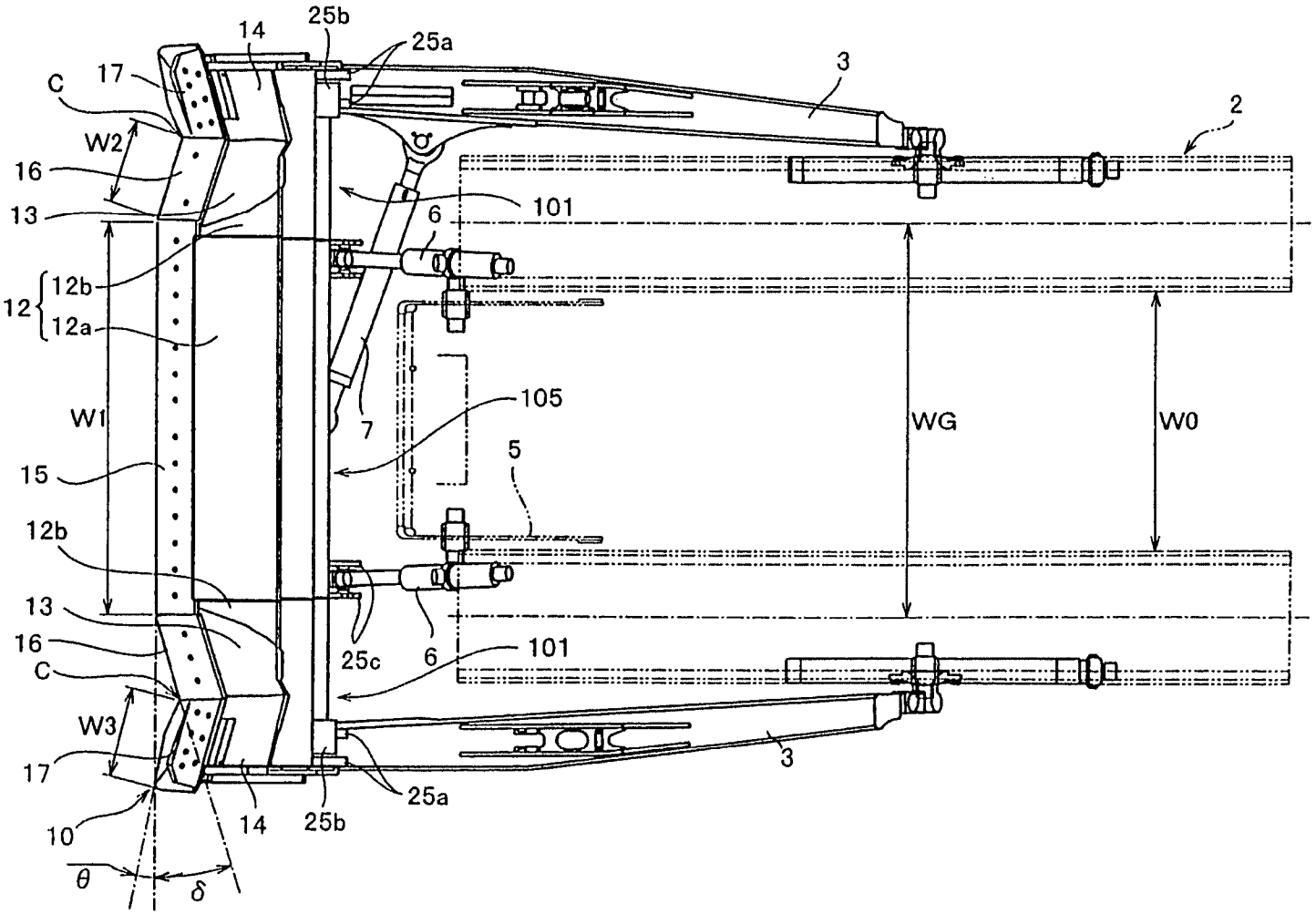
FIG. 5 is a plan view of an example of a structure of an essential portion of the working machine.

As shown in FIG. 5, in the blade device 10 of the invention, tip ends of the third cutters 17 of the end front faces 14 are disposed substantially on the side edge of the central front face 12 and the extension of the first cutter 15, but they may be retracted from the extension or may project slightly forward from the extension. In short, they may be bent and extended continuously from the left and right side edges of the central front face 12 while spreading the coupling front face 13 rearward, and bent and continuous while spreading forward from the side edges of the outsides of the left and right coupling front faces 13. However, the cross line between the coupling front face 13 and the end front face 14 and the intersection C between the second cutter 16 and the third cutter 17 must be located rear position of the left and right side edges of the central front face 12 and the first cutter 15. In the invention, the end front face 14 includes a case in which the end front face 14 extends in parallel to the extension of the lower end of the central front face 12.

The embodiment is different from the patent document 2 in that in the embodiment, left and right end regions B of the central front face 12, the coupling front face 13 and the end front face 14 are integrally molded including back faces, a central main region A of the central front face 12 is independently formed with a front face plate 106 and a later-described back support member 107, and they are integrally formed by welding. At least the central main region A of the front face plate 106 of the central front face 12 of the embodiment is made of rolled-steel sheet metal, sheet metal is partially used in the back support member 107 corresponding to the front face plate 106, and a molded component only for the back support member which is molded separately from the other integrally molded portion is used for a portion which requires strength. In the embodiment, trapezoidal sheet metal material 18 extends along an upper end edge of the central front face 12 including the molded portion by welding. Left and right triangular portions of the sheet metal material 18 are lattice portion including a plurality of lattices 18*a*. The lattice portion is provided so that an operator can visually check the amount of soil existing in front of both ends of the blade device at the time of operation. A central rectangular portion of the sheet metal material 18 has a function of a spill guard for preventing soil deposited on the central front face from overflowing rearward at the time of soil transportation.

If the blade device of the invention is formed of sheet metal material entirely, the number of parts is largely increased, and extremely precise positioning and high welding technique are required due to its peculiar shape as described above. Further, a reinforcing rib must be provided at the bending boundary between the coupling front face and the end front face, the thickness of the sheet metal for improving the rigidity and strength of the support member must be increased at the same time and thus, its weight is increased. When a blade has a small capacity or when a blade is specially ordered instead of general blade capacity, the total cost can be increased relatively, and a molded product may not be combined as in the embodiment.

Figure 2:
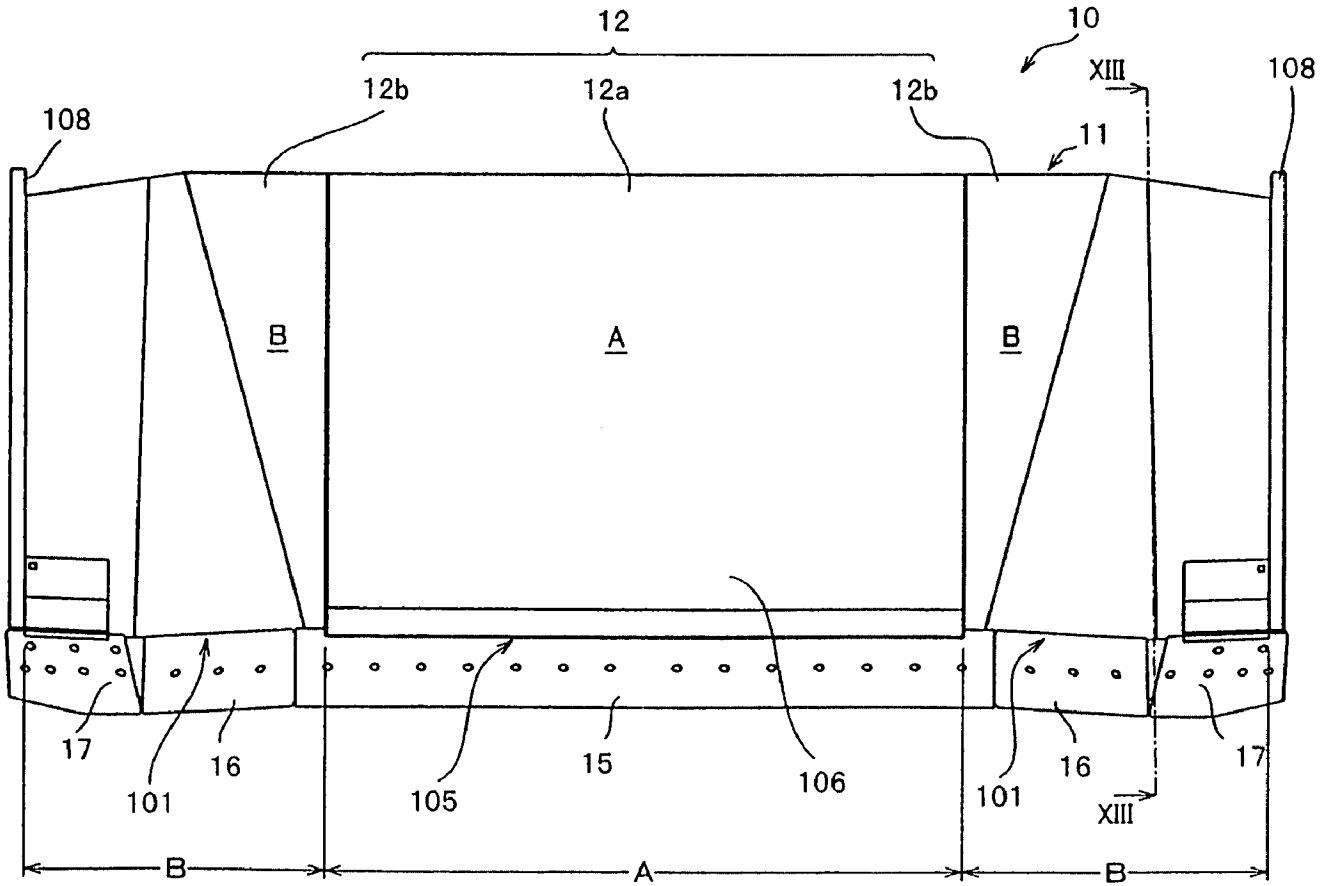
FIG. 2 is a front view of the blade.

In the embodiment, as shown in FIGS. 1 and 2, the central front face 12 having a substantially reversed trapezoidal shape as viewed from front is divided into three pieces, i.e., a rectangular divided central portion 12*a* of the central main region A, and substantially reversed triangular divided ends 12*b* which are the left and right end regions B. The coupling front faces 13 are connected to the divided ends 12*b* such that the coupling front faces 13 are opened in a V-shape or U-shape rearward at a predetermined backward-bending angle δ, and the end front faces 14 are connected to the coupling front faces 13 such that the end front faces 14 are opened forward in a V-shape or U-shape at a predetermined crossing angle θ with respect to the extension of the lower end tip of the central front face 12. At that time, the entire face or a portion of the entire face of the front faces of the central front face 12, the coupling front faces 13 and the end front faces 14 are curved in the concave manner with the same curvature in the vertical direction.

In the embodiment, as described above, the divided ends 12*b* of the central front face 12 provided at its front face with left and right bent faces and upper and lower curved faces, the coupling front faces 13 and the end front faces 14 are integrally molded including the back support member 107, thereby forming an integrally molded portion 101. The rectangular divided central portion 12*a* of the central front face 12 has the front face plate 106 as a main constituent member. The front face plate 106 is constituted by a sheet metal portion 105 made of sheet metal.

The rectangular divided central portion 12*a* includes the front face plate 106 and the back support member 107. In the front view in FIG. 2, the front face plate 106 is laterally long rectangular in shape. The front face plate 106 is a plate member constituting a central rectangular portion when both ends of an upper bottom of the central front face 12 having the substantially reversed trapezoidal shape is cut vertically toward the lower bottom, i.e., a front face of the rectangular divided central portion 12*a*. Both end reversed triangular portions which are the cut remaining portions are integrally molded together with the coupling front faces 13 and the end front faces 14 including the back support portion, thereby forming the divided ends 12*b*. In this specification, regions including the front face plate 106 in the central front face 12 constituted by sheet metal, the sheet metal material 18 extending to the upper end edge thereof, and its back support member 107 are called a sheet metal portion 105, and a region which is integrally molded including the back face portion 103 of the other blade portion except the sheet metal portion 105 is called the integrally molded portion 101. If the central front face 12 is divided into the rectangular divided central portion 12*a* and the triangular divided ends 12*b* through the vertical lines, the front faces of the rectangular divided central portion 12*a* and the triangular divided end 12*b* are formed as smoothly continuous curved faces, and the coupling lines are straight lines extending along the curved faces as viewed from front and thus, automatic welding using a welding robot without using manual operation can be carried out for welding operation in the assembling process.

Figure 4:
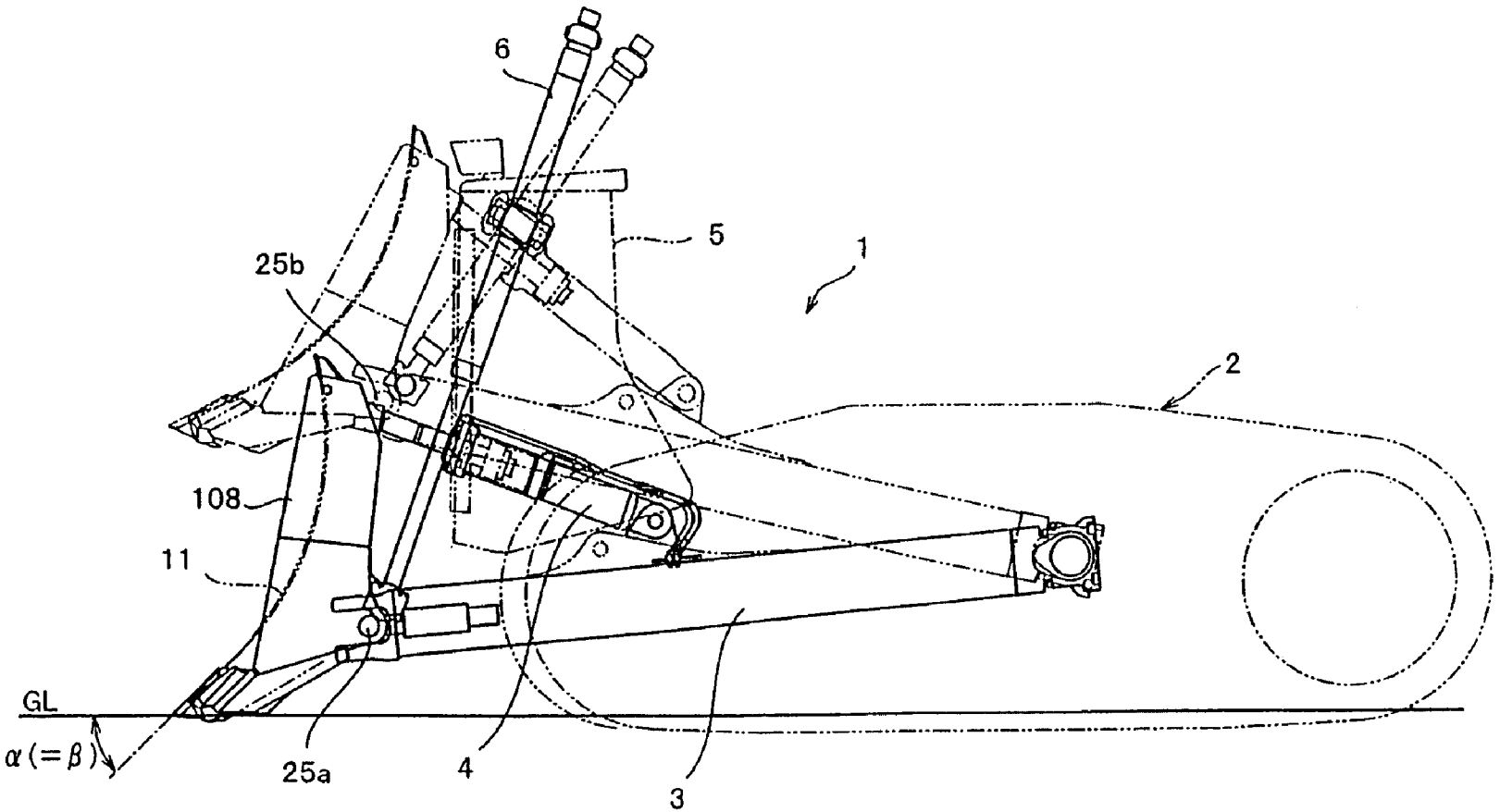
FIG. 4 is a side view showing an entire working machine for explaining a vertical motion of a blade of the blade.
Figure 11:
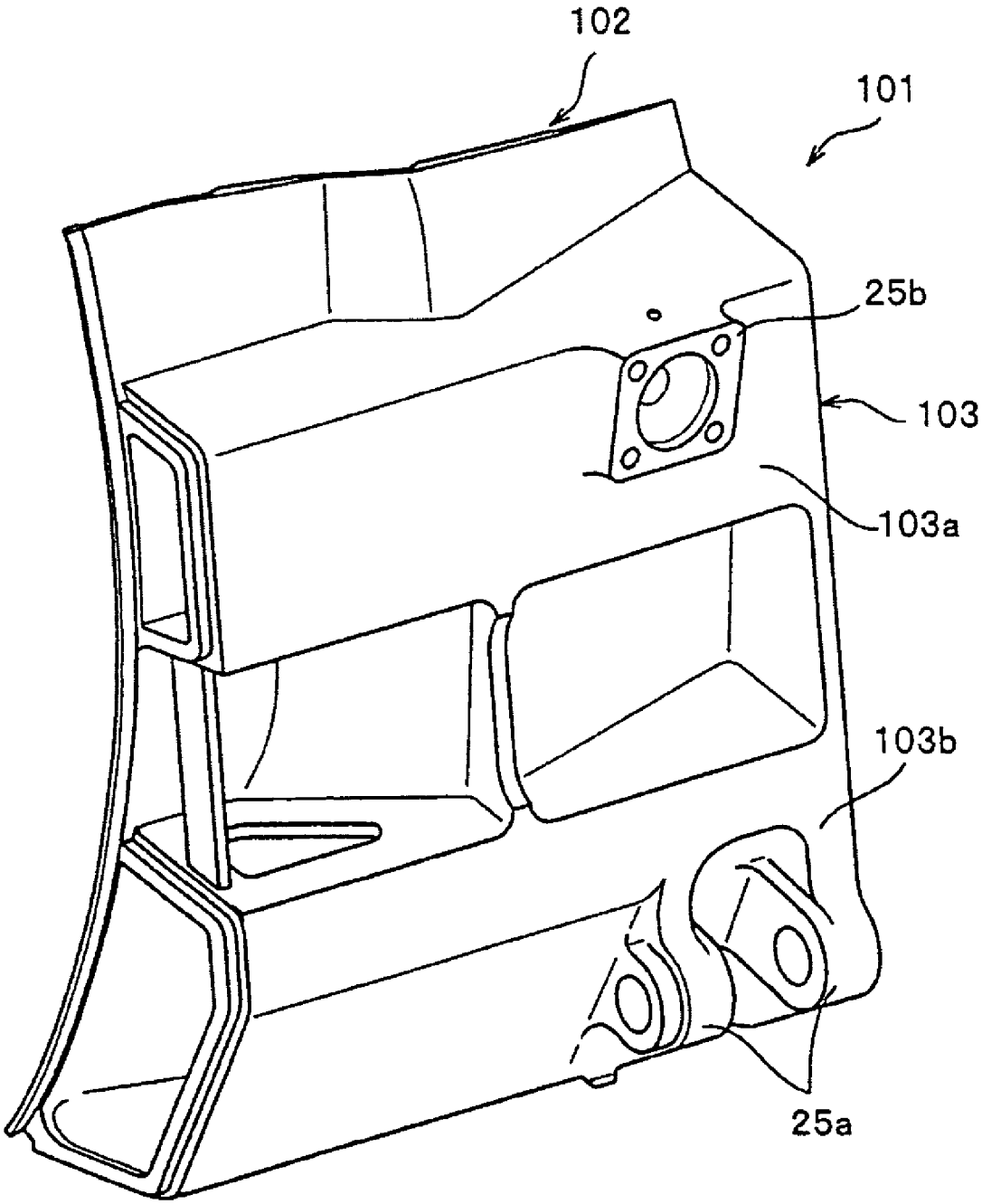
FIG. 11 is a perspective view of a left integrally molded portion in the blade device as viewed from left of a back face.
Figure 12:
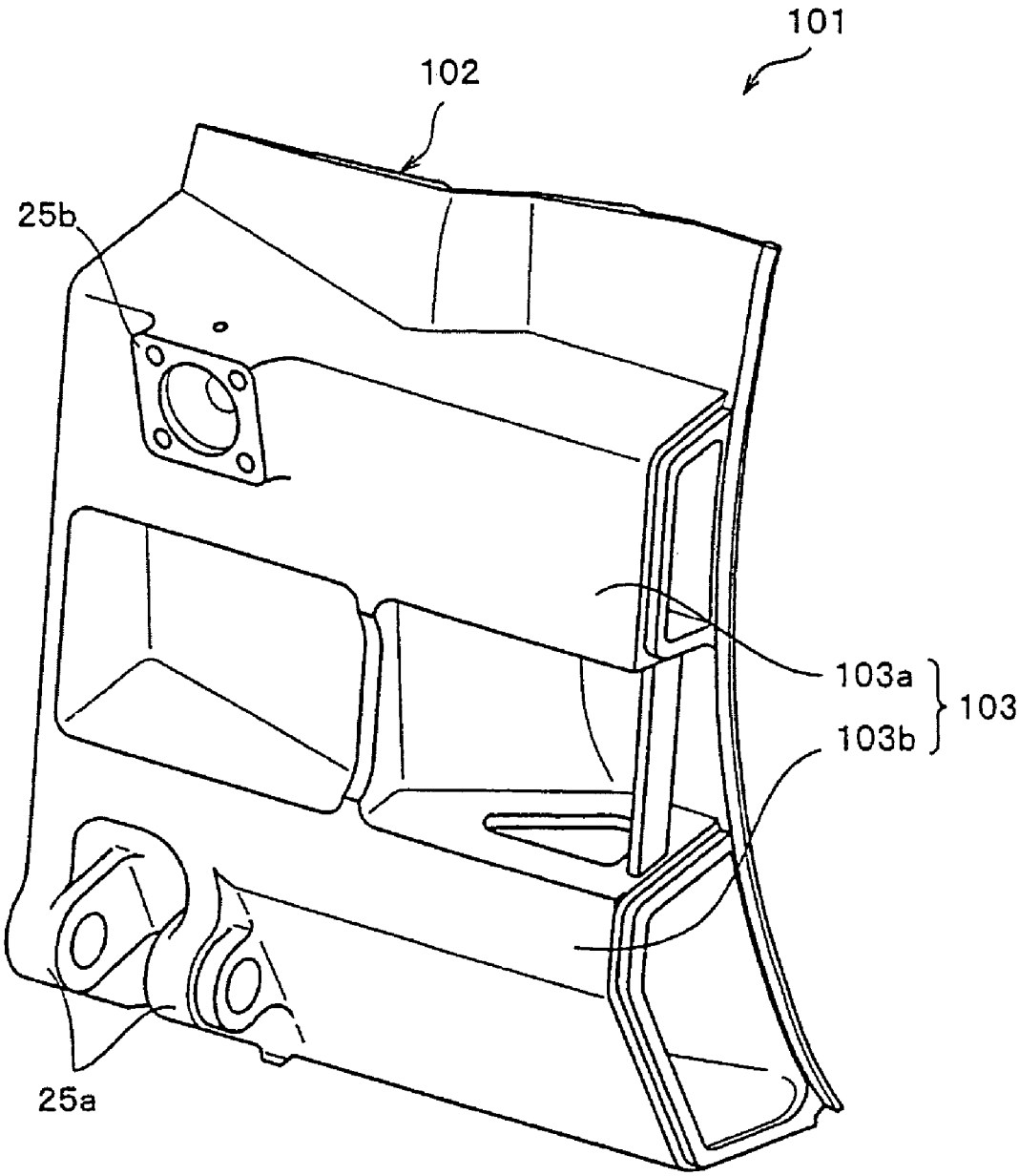
FIG. 12 is a perspective view of a right integrally molded portion in the blade device as viewed from right of the back face.

FIGS. 4 and 5 shows a schematic structure when the blade device 10 of the embodiment is mounted on a bulldozer 1. The blade device 10 is disposed on a front portion of the bulldozer 1, a base end is pivotally supported by a central portion of a track-type driving device 2, a pair of lift frames 3 extends forward, a (hydraulic) tilt cylinder 4 has a base end pivotally supported by a central portion of the lift frame 3 and extends forward, a (hydraulic) lift cylinder 6 having one end of a cylinder body pivotally supported by a side wall of the engine compartment 5 disposed in front of a operator's seat, and a front end of a strut arm 7 diagonally extending toward a central portion of a back face of the blade 11 as viewed from above, a base end of the lift frame 3 is pivotally supported. Thus, a bracket for supporting the lift frame rearwardly project normally from a back support member of the blade. In the embodiment, as shown in FIGS. 11 and 12, in a pair of left and right integrally molded portions 101 of the blade 11, left and right first brackets 25*a* which support a front end of the lift frame 3 are integrally molded and projected rearward from an outer lower end corner of the back face portion 103. A second bracket 25*b* which supports a front end of the (hydraulic) tilt cylinder 4 is integrally molded and projected rearward from an upper portion of the bracket 25*a* of the back face portion 103.

A front face of the coupling front face 13 of the embodiment has a substantially triangular or vertically long trapezoidal shape which is formed such that its width is gradually increased from an upper end toward a lower end reversely to the central front face 12. As viewed from front as shown in FIG. 2, a side edge thereof is curved and extended in the same direction as a connection side end edge of the central front face 12. The front face of the end front face 14 has substantially the same width from its upper end to the lower end as viewed from front, and is formed into a vertically long substantially rectangular shape which is curved in the concave manner having the same curvature as those of the central front face 12 and the coupling front face 13. In the embodiment, the extension of the lower end of the central front face 12 substantially matches with the tip end position of the end front face 14. The entire shape of the blade 11 is a laterally long rectangular shape as viewed from front. As shown in FIG. 1, the front faces of the front faces 12, 13 and 14 are coupled to each other in a V-shape which largely spreads in the horizontal direction in the lateral direction. The drawings show the V-shape but the invention is not limited to this shape, and U-shape in which an open end is largely opened may be employed. Here, the expression "as viewed from front" means "as viewed from front" when the cutter comes into contact with the ground at a tip angle α (equal to excavation angle β in this embodiment) having high excavation efficiency as shown in FIG. 4.

The excavation efficiency is varied by the tip angle α as described above, but according to the test carried out by the present inventor, the blade width W1 of the lower end of the central front face 12, the backward-bending angle δ of the second cutter 16 with respect to the first cutter 15, and a distance (retraction amount, hereinafter) Wt between the coupling front face 13 which intersects behind the extension of the first cutter 15 and the extension and the intersection C of the tip of the end front face 14 are largely influenced, and other factors also relate, but it is found that the second cutter 16 of the coupling front face 13 and the third cutter 17 of the end front face 14 are largely influenced. The influence depends on a manner of relative determination of the blade width of the second cutter 16 and the blade width of the third cutter 17.

It is found from another test that the blade width W1 of the lower end of the central front face 12 related to the size of the working machine, the backward-bending angle δ of the second cutter 16 with respect to the first cutter 15, and the distance (retraction amount, hereinafter) wt between the extension of the first cutter 15 and the intersection C of the tips of the coupling front face 13 and the end front face 14 are also largely influenced. The W1 can take a size of 0.4 to 0.9 times of a distance between a pair of left and right bracket devices 25*a*, but efficiency when the excavation and soil transportation and side cut are carried out is taken into account, in this embodiment, the lower blade width W1 of the end of the central front face 12 is set substantially equal to the distance WG (gage width) between the width centers of the left and right driving devices (crawler tracks).

Figure 6:
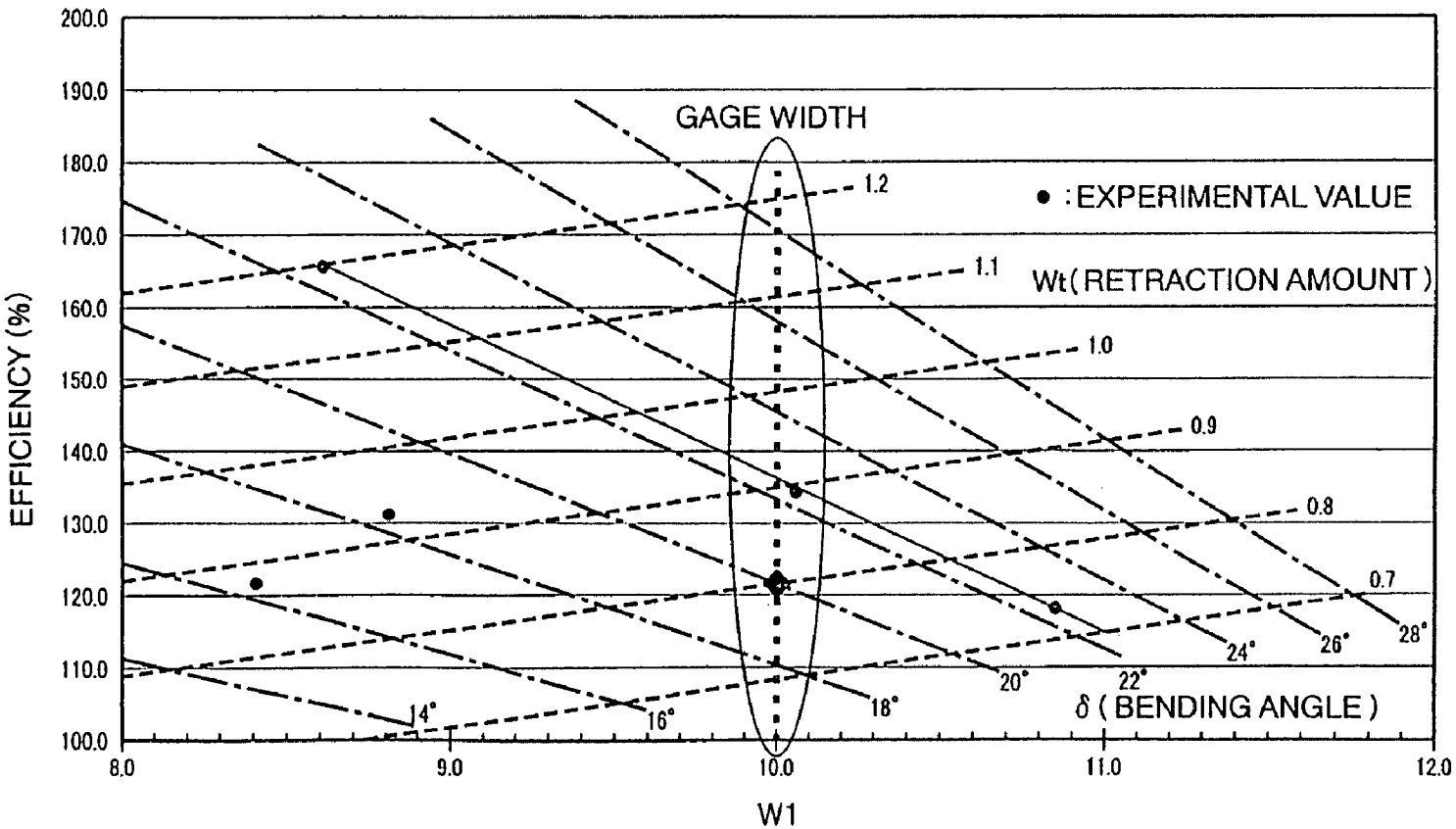
FIG. 6 is a correlation diagram showing excavation efficiency of the blade with respect to the blade width of the central front face based on the retraction amount of the intersection and the backward-bending angle.

FIG. 6 shows a result of the test. The excavation efficiency corresponding to variation of the blade width W1 of the lower end of the central front face 12 is determined by correlation between the backward-bending angle δ which bends rearward of the second cutter 16, and a retraction amount Wt between the extension of the first cutter 15 and the intersection C between the tips 16 and 17 of the second and third cutters. FIG. 6 has a semi-U type blade having a shape which is the closest to the blade device of the invention as a reference, but it can be said that other type of machine as the same correlation in the actual case.

The lateral axis in FIG. 6 shows a variation in length of the blade width W1 in which the most standard length (gage width of a vehicle driving device on which the blade device is mounted) of the blade width W1 is defined as 10 (no unit). That is, if the actual length of the blade width W1 is M (mm), M is defined as 10, and if a blade width of a blade which is smaller than the former blade is L (mm), L obtained by 10×L/M corresponds to a value indicated on the lateral axis, and if a blade width of a blade larger than the standard length is N (mm), 10×N/M corresponds to a value on the lateral axis. The vertical axis in FIG. 6 shows a variation of the excavation efficiency, the excavation efficiency of the semi-U type blade is defined as 100% as a reference value thereof, and shows a variation of the excavation efficiency (%) by the blade of the present invention having the entire width of the same blade. A group of curves shown with dashed lines in FIG. 6 shows variation in excavation efficiency corresponding to a variation in the blade width W1 when the backward-bending angle δ is changed. A straight line group shown with broken lines show a variation in excavation efficiency corresponding to a variation in blade width W1 when a retraction amount Wt between the extension of the first cutter 15 and the intersection C between the tips 16 and 17 of the second and third cutters. Here, Wt is a coefficient (no unit), and a value obtained by multiplying this coefficient by a reference value (M/10) is an actual value.

When the blade device 10 of the present invention having the blade width W1 of the central front face 12 determined by the width of the running device of the vehicle to be mounted is designed, If a backward-bending angle and a retraction amount Wt corresponding to the straight lines when a straight line group of the dashed lines and a straight line group of the broken lines intersect on the vertical axis passing through the blade width W1 are employed, desired excavation efficiency can be obtained. In order to realize excavation efficiency which exceeds a semi-U type blade having the same central blade widths when the blade width W1 of the central front face 12 is defined as 10 (central portion of the lateral axis) based on FIG. 6, if the backward-bending angle δ is defined as about 16.2° and the retraction amount Wt is defined as 0.63, excavation efficiency which is equal to the semi-U type blade can be obtained.

That is, when the blade width W1 of the central front face 12 is 10, if the backward-bending angle δ is defined as 16° and the retraction amount Wt is defined as 0.65, the same excavation efficiency as that of the semi-U type blade of the same blade volume is secured, the backward-bending angle δ is set larger than 16°, the retraction amount Wt is set larger than 0.65, and they are set as a backward-bending angle δ and retraction amount Wt of a point where the dashed line where the backward-bending angle δ is 16° or larger and the broken line where the retraction amount Wt is 0.65 or more pass through the blade width W1, excavation efficiency which exceeds the semi-U type blade corresponding to the intersection between the dashed line and the broken line can be realized. That is, the above-described expressions (I) and (II), i.e., $$Wt > 0.65 \times (W1/10) \quad \text{(I)}$$

$$14° < \delta < 30° \quad \text{(II)}$$

are satisfied at the same time, the most efficient blade shape having small soil drop amount at the time of turning while pushing can be obtained. In the illustrated example, when the blade width W1 is 10 of the reference value, if the backward-bending angle δ is set to 20° and the retraction amount Wt is set to 0.8 (a symbol ♦ in FIG. 6), the excavation efficiency becomes 122% and is largely increased.

However, with the correlation diagram in FIG. 6 only, the upper limits of the backward-bending angle δ and retraction amount Wt cannot be determined. According to another test, if turning while pushing operations are carried out by turning running, the transported soil loaded on the front face of the blade 11 drops from the end front face 14 through the coupling front face 14 within a few tens seconds, and the amount of loaded soil becomes zero instantaneously. Its reason was researched, and it was found that the backward-bending angle δ was one of the biggest reasons. That is, if the backward-bending angle δ is set to 30° or greater, slip of transported soil is generated. Hence, in this invention, a value of the retraction amount Wt is set larger than a value obtained by multiplying the blade width W1 of the lower end of the central front face 12 determined by the blade volume by 0.65/10 and in a range of 16° or more and 30° or less, and the backward-bending angle δ in which the excavation efficiency becomes the highest is obtained from a previously formed correlation diagram.

Figure 7:
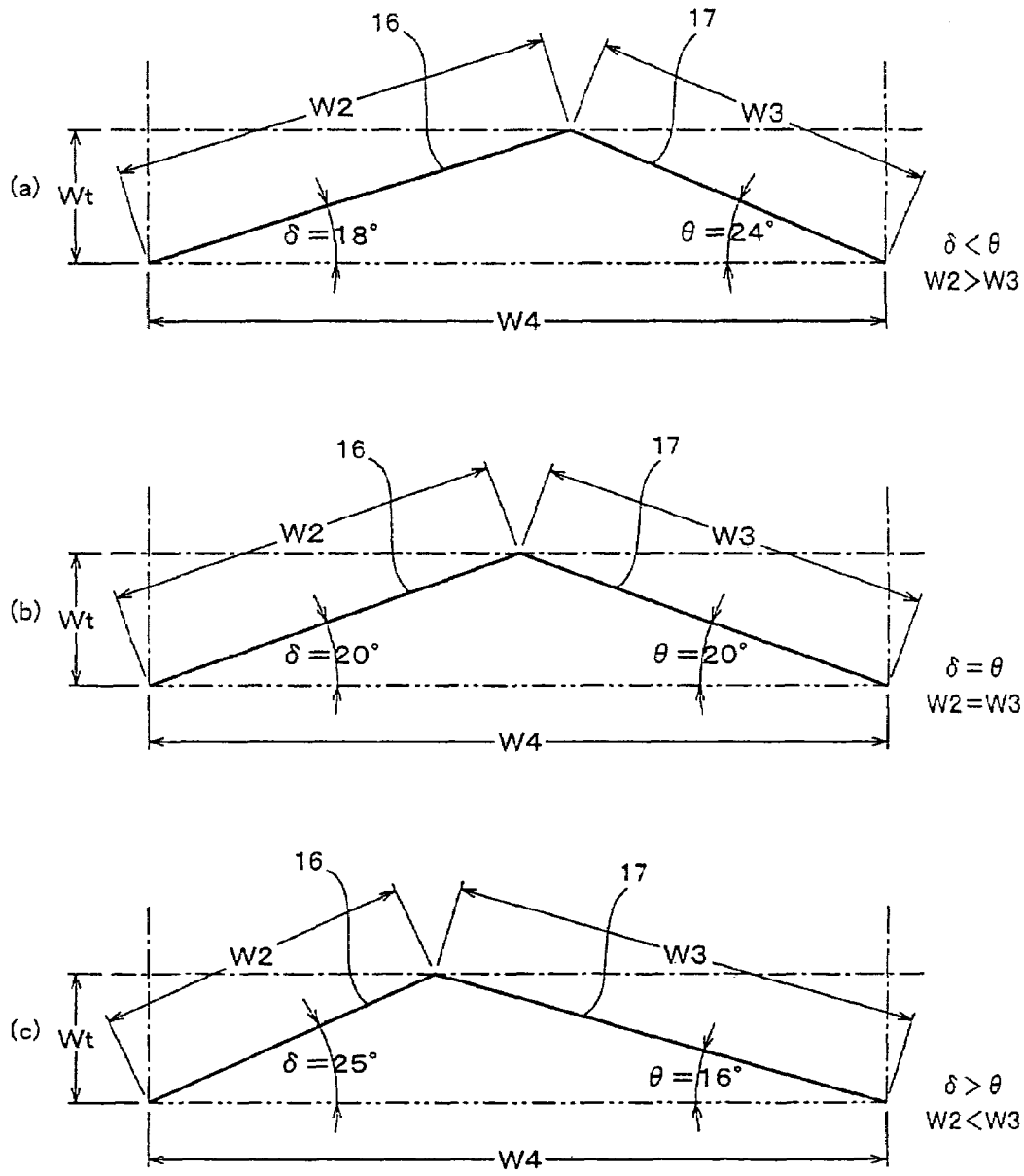
FIG. 7 are explanatory diagrams for explaining a relation between blade widths of the coupling front face and the end front face which is varied when the backward-bending angle and the crossing angle are varied.

In the blade device 10 of the invention, the entire blade width W can be determined by the blade capacity and the blade width W1 of the central front face 12 can be determined by the vehicle size. Therefore, a straight line distance connecting the front end of the coupling front face 13 located on the intersecting retracted position and the front end of the end front face 14 is necessarily determined. Hence, the straight line distance connecting the front end of the coupling front face 13 and the front end of the end front face 14 to each other is determined, but it is not possible to constantly determine which one of the blade widths W2 and W3 of the lower ends of the coupling front face 13 and the end front face 14 should be increased. As shown in FIGS. 7(*a*) to (*c*), when the distance between the extension of the tip of the central front face 12 and the intersection C between the tips of the coupling front face 13 and the end front face, i.e., the straight distance W4 connecting the retraction amount Wt, the front end of the coupling front face and the front end of the end front face 14 are made constant, the drawings show a variation in a ratio of lengths of the blade widths W2 and W3 of the lower ends of the coupling front face 13 and the end front face 14 when the backward-bending angle δ and the crossing angle θ at which the excavation efficiency is the highest and the amount of dropped soil at the time of turning while pushing operations can be reduced.

In FIG. 7(*c*), when the length of the third cutter 17 of the end front face 14 in the blade width direction is longer than that of the second cutter 16 of the coupling front face 13, the side cut amount is great, and the amount of soil flowing from the end front face 14 to the side is reduced. When the length of the second cutter 16 of the coupling front face 13 in the direction of the blade width is shorter than that of the third cutter 17 of the end front face 14 on the other hand (FIG. 7(*a*)), the side cut amount is reduced and the amount of soil discharged from the end front face 14 to the side is also increased.

The most ideal aspect is that the excavation by the coupling front face and the end front face assorts with the excavation by the central front face and shows the maximum excavation force as the entire blade device. FIG. 7(*b*) shows its one example. FIG. 7(*b*) shows a shape in which the amount of soil transportation by the central front face 12 and the amount of soil transportation by the end front face 14 and the coupling front face 13 are balanced, and one example thereof is when the blade widths W2 and W3 of lower ends of the coupling front face 13 and the end front face 14 are equal to each other. The constraint as to which one of the blade widths W2 and W3 of the lower ends of the coupling front face 13 and the end front face 14 should be increased is determined while taking the balance between a function required by the end front face 14 and a holding function of the soil transportation into account based three parameters, i.e., the retraction amount Wt, the backward-bending angle δ and the crossing angle θ. According to a result of a test carried out by the present inventors, it was found that if the value (W3/W2) of a ratio of the blade width W3 of the third cutter to the blade width W2 of the second cutter 16 was in a range of 0.5 to 2, a variation in the excavation efficiency could be eliminated, and it exceeds the conventional excavation efficiency and stabilized. Further preferable ratio (W3/W2) is 0.7 or more and 1.3 or less.

Figure 8:
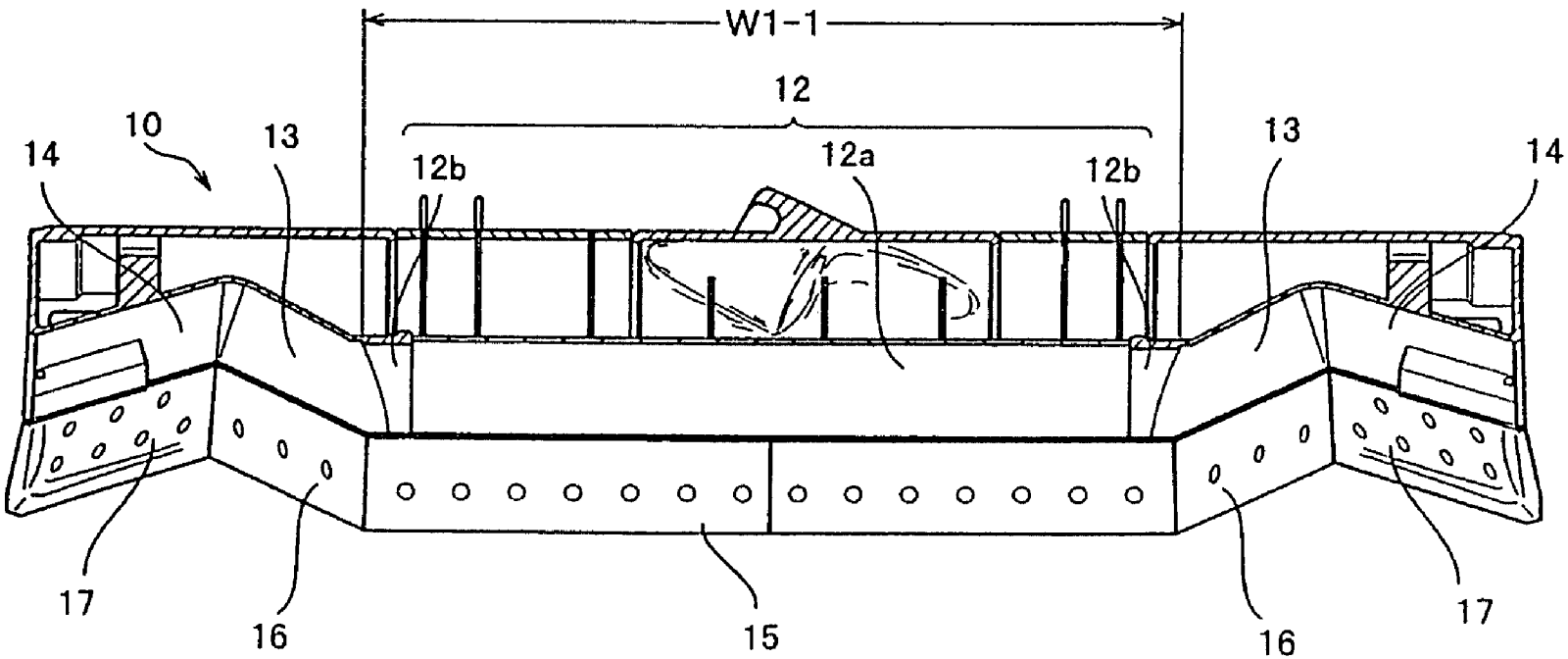
FIG. 8 is a cross-sectional view seen in the direction of the arrow taken along the line IIX-IIX in FIG. 1.
Figure 9:
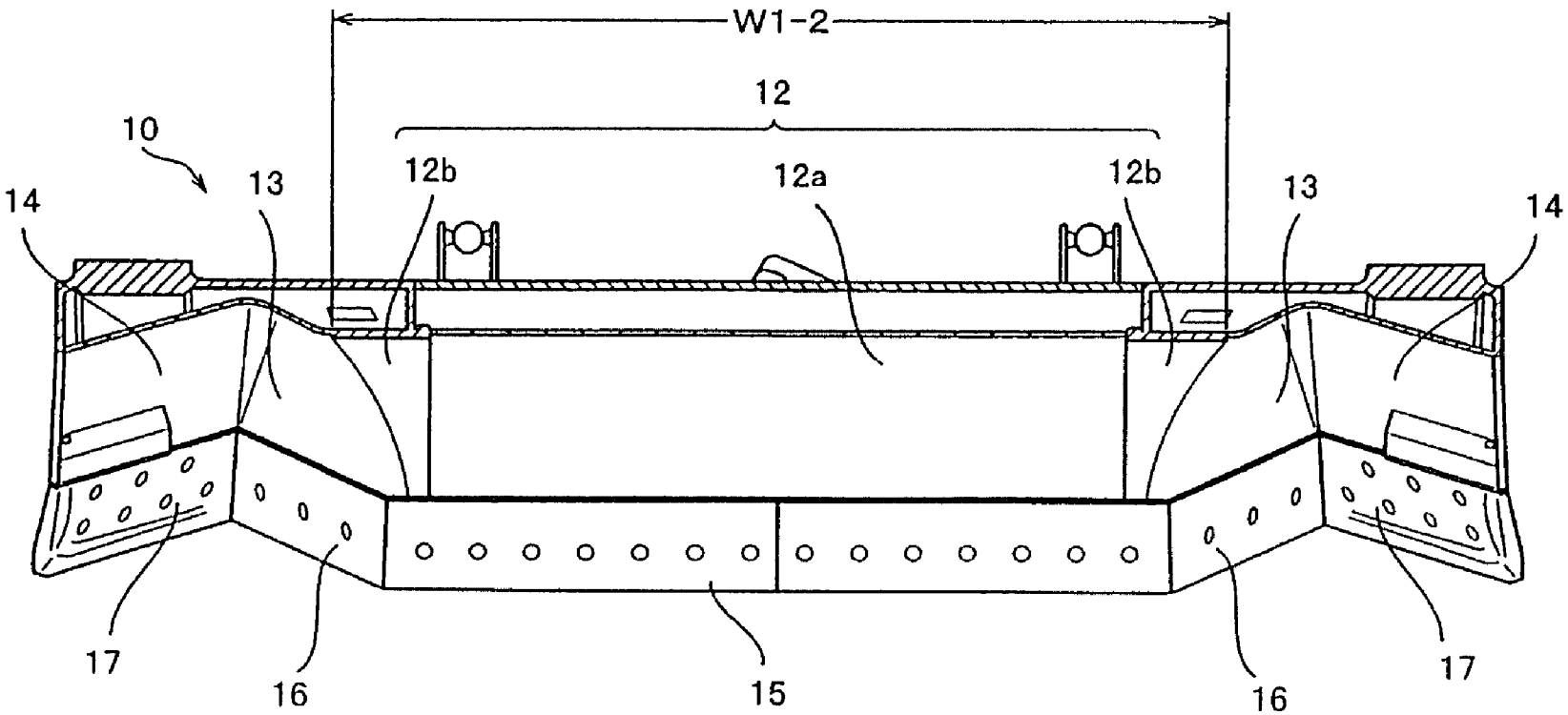
FIG. 9 is a cross-sectional view seen in the direction of the arrow taken along the line IX-IX in FIG. 1.
Figure 10:
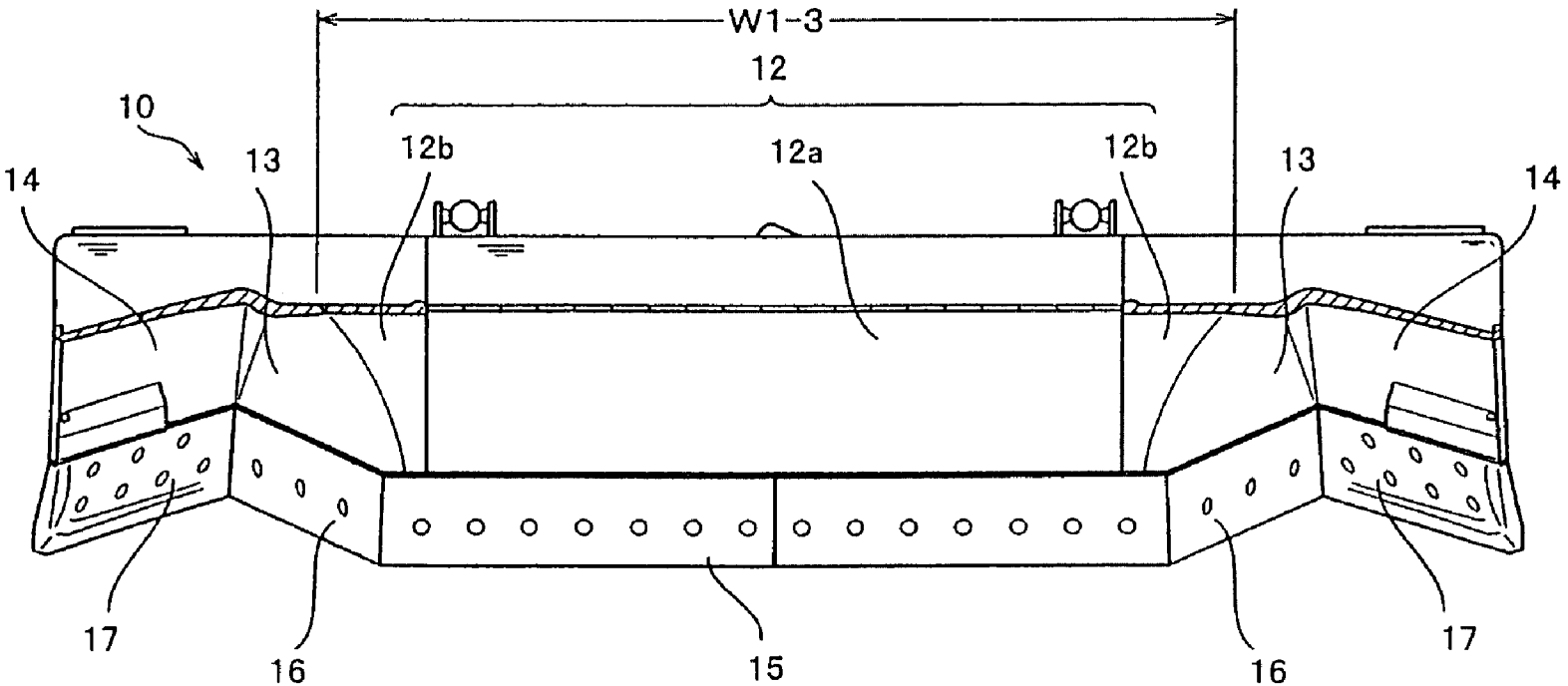
FIG. 10 is a cross-sectional view seen in the direction of the arrow taken along the line X-X in FIG. 1.

FIGS. 8 to 10 are cross-sectional views of the blade 11 taken along the IIX-IIX line to the X-X line in FIG. 1. As can be understood from these drawings, the front face of the blade 11 of the mm is formed into the curved face which is concaved rearward between upper and lower portions which is rearwardly inclined around the lower end edge of the central front face 12, and the blade width of the front face of the central front face 12 is gradually increased in width from the lower end edge toward the upper end edge in the order of W1-1<W1-2<W1-3. If the blade width is gradually increased while orientating the central front face 12 upward, soil excavated by the first to third cutters 15 to 17 of the central front face 12, the left and right coupling front faces 13 and the left and right end front faces 14 passes through the curved face and the bent line and sequentially pushes up the central front face 12. As the central front face 12 goes upward, its bosom is gradually widened and thus, it is possible to receive more transported soil, and if the central front face 12 is compared with a simply rectangular front face, the central front face 12 is curved and thus, more transported soil can be held.

FIGS. 11 and 12 show the entire pair of left and right integrally molded portions 101. As can be understood from these drawings, the left and right integrally molded portions 101 are symmetric with respect to faces. The integrally molded portion 101 of the embodiment is provided at its front face with the front face plate 102 and at its back face with the back face portion 103 and the first and second brackets 25*a* and 25*b*. The entire front face plate 102 has the same thickness. In the front face plate 102, only the upper end edges of the bent connected portions between the triangular divided ends 12*b* of the central front face 12 (see FIG. 1), the coupling front face 13 and the end front face 14 are thicker than other portions, thereby increasing the rigidity and strength (see FIGS. 11 to 15).

As shown in FIGS. 11 and 12, in the back face portion 103 of the integrally molded portion 101, laterally long rectangular cylindrical first and second back support portions 103*a* and 103*b* project rearward from the central portion of the upper portion and the lower end. A space between the back support portions 103*a* and 103*b* is reinforced by a reinforcing columnar, and an inside thereof is hollow which is in communication with left and right portions for reducing the weight. The vertical cross section shape of the hollow is varied in accordance with the bent connection portion of the front face plate 102, and the cross section of the hollow is the smallest to secure the rigidity and strength at the molding position of the first bracket 25*a*.

Figure 13:
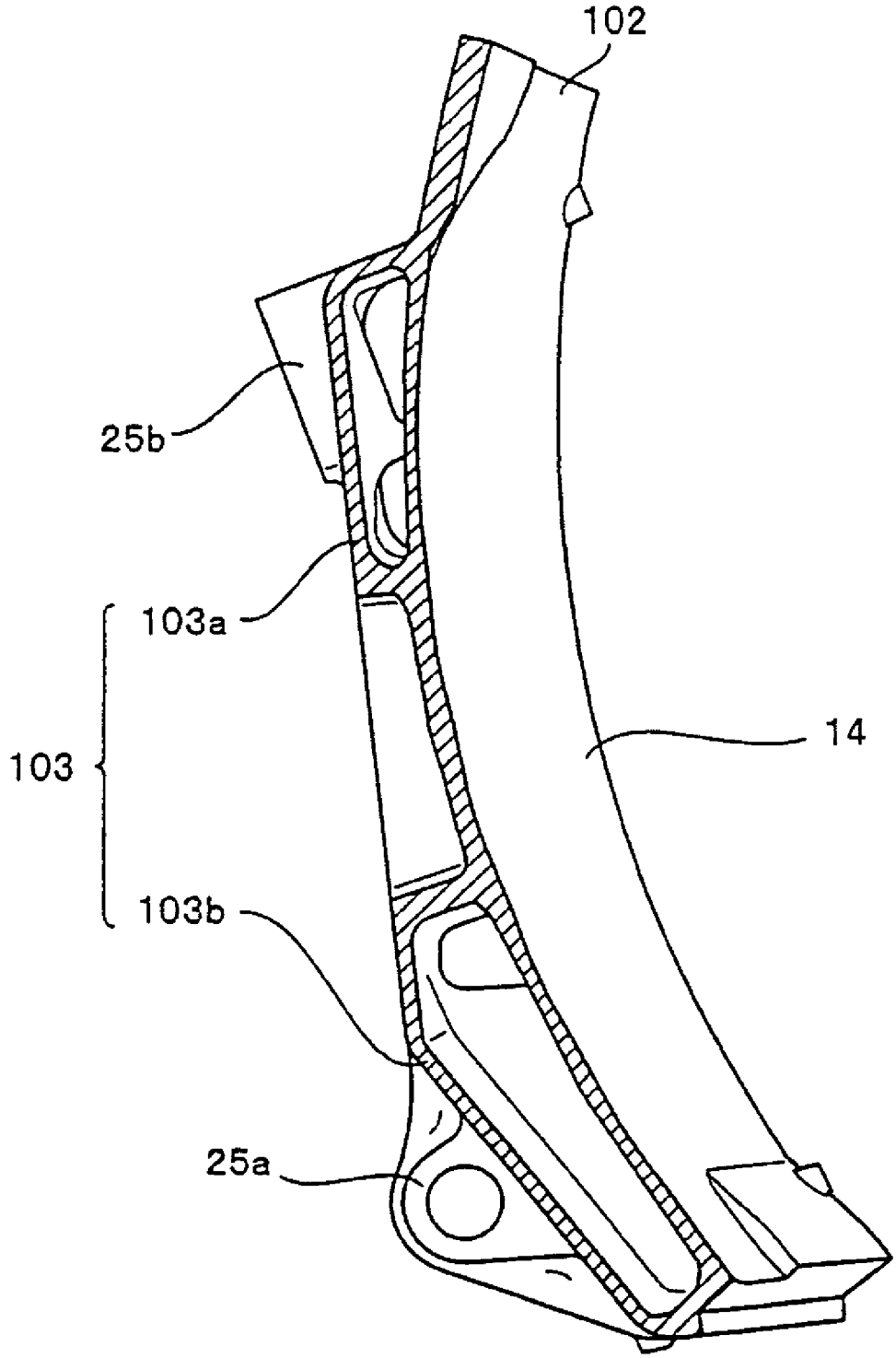
FIG. 13 is a cross-sectional view seen in the direction of the arrow taken along the line XIII-XIII in FIG. 2.
Figure 14:
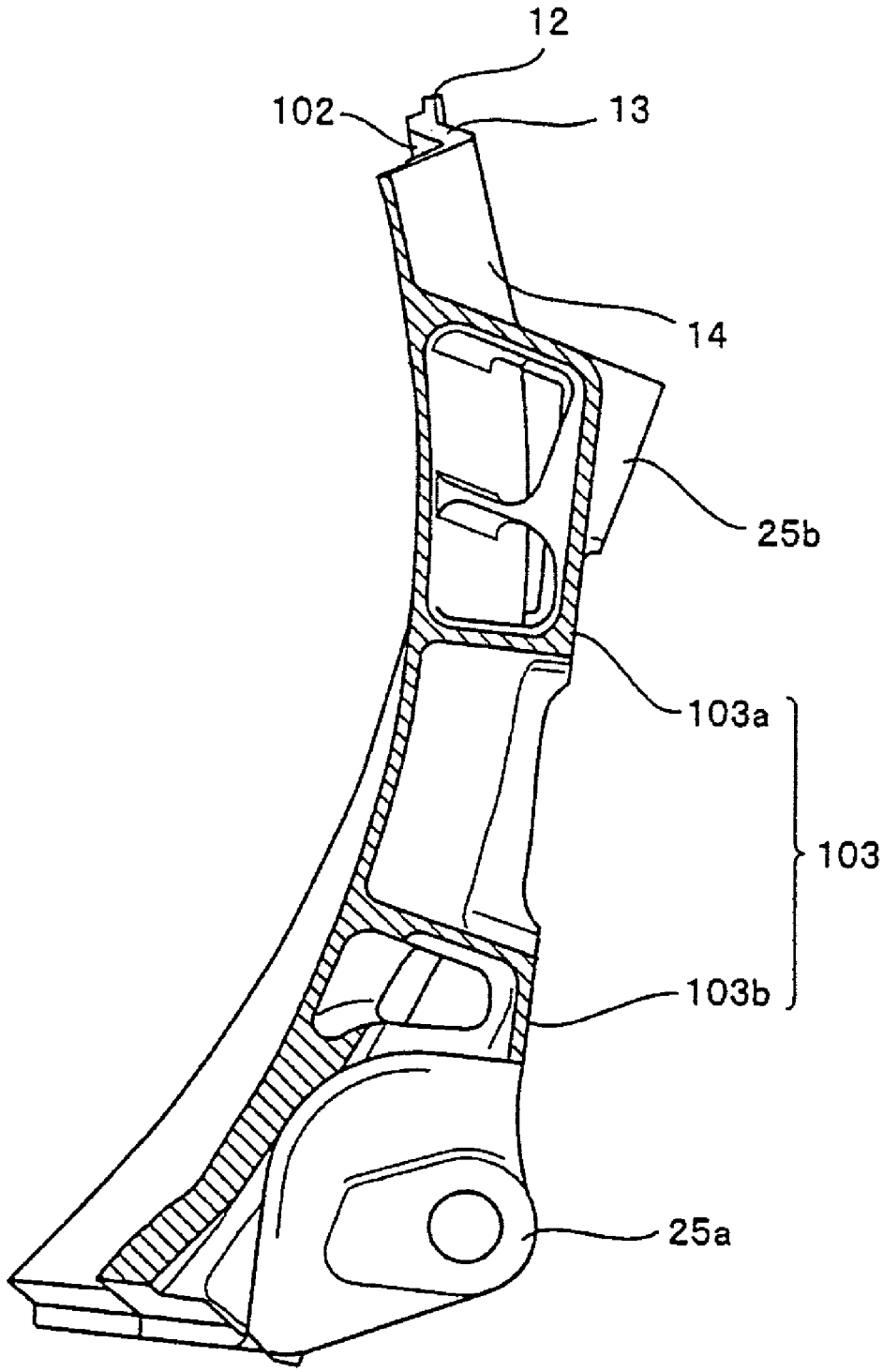
FIG. 14 is a cross-sectional view seen in the direction of the arrow taken along the line XIV-XIV in FIG. 3.
Figure 15:
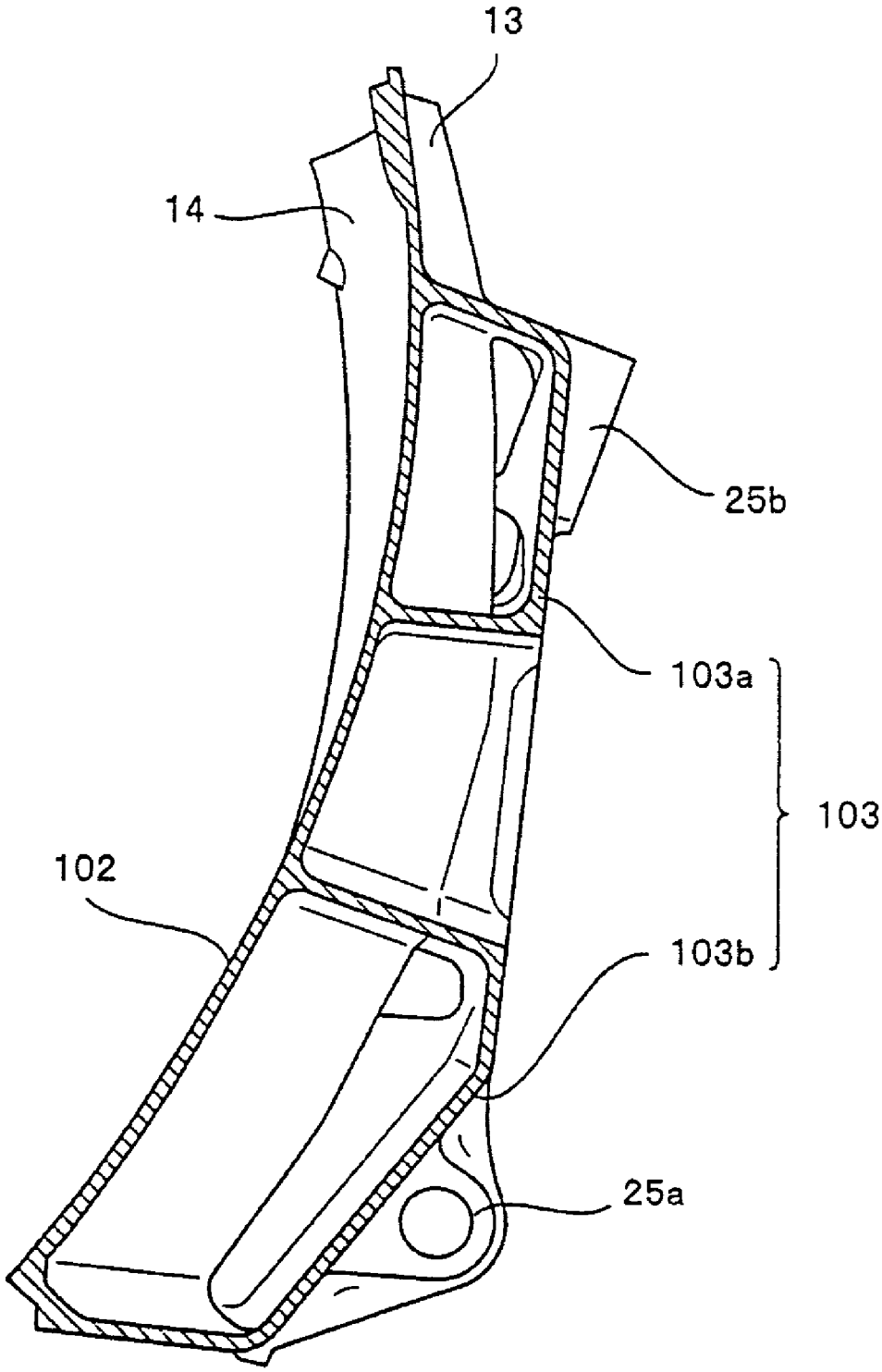
FIG. 15 is a cross-sectional view seen in the direction of the arrow taken along the line XV-XV in FIG. 3.

That is, FIG. 13 is a cross-sectional view taken along the line XIII-XIII in FIG. 2. This cross-sectional view shows a cross section of the hollow extending along the bent line in the front face plate 102 of the coupling front face 13, the end front face 14. FIG. 14 is a cross-sectional view taken along the line XIV-XIV in FIG. 3, and shows a cross section along the vertical line passing through an intermediate portion of the pair of left and right first brackets 25*a* formed on the right end as viewed from front. FIG. 15 is a cross-sectional view taken along the line XV-XV in FIG. 3, and shows a cross section of a molded portion close to a boundary between the integrally molded portion 101 and the sheet metal portion 105.

Figure 16:
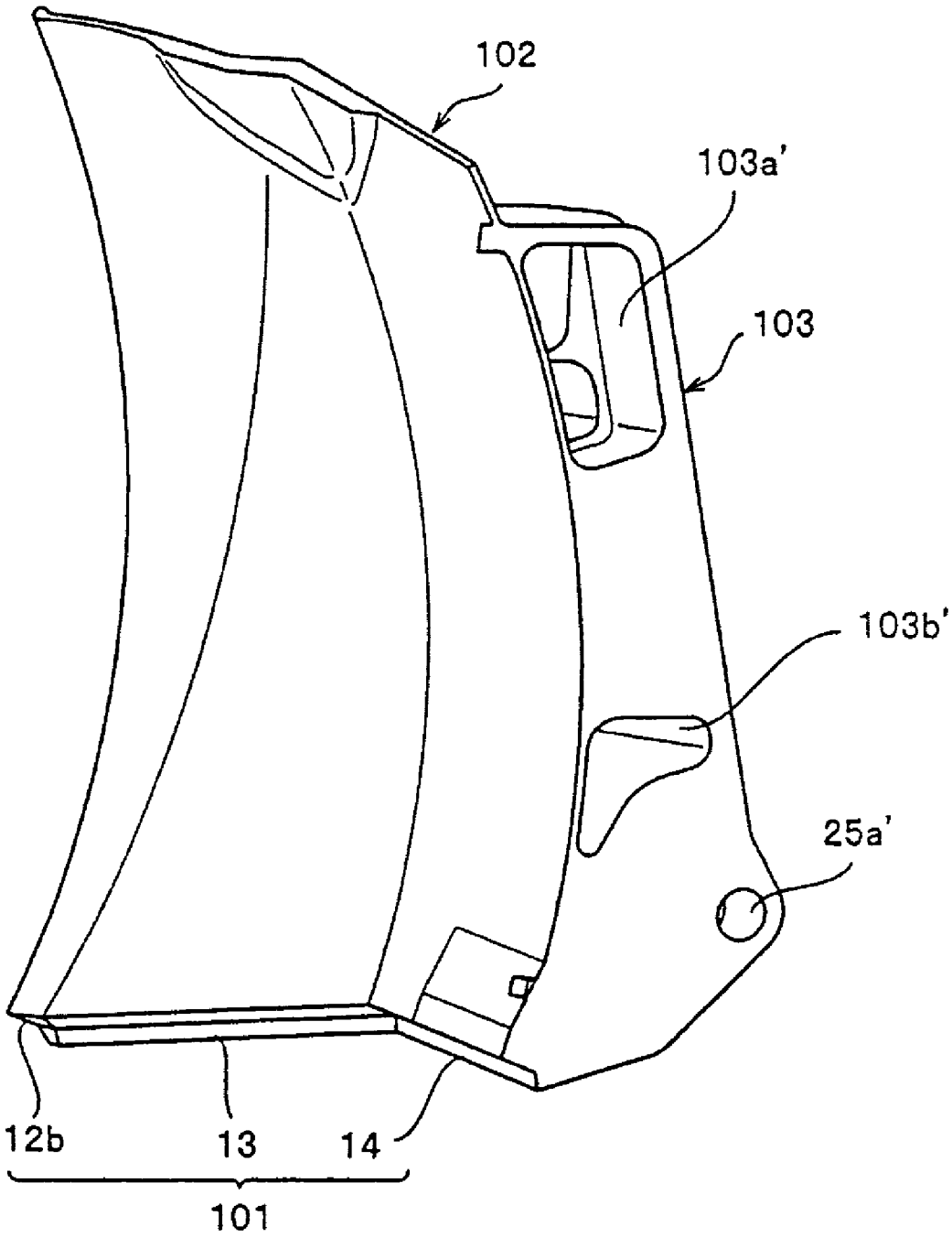
FIG. 16 is a perspective view of the right integrally molded portion as viewed from front and diagonally right side.

As can be understood from these drawings, the distance between the front face plate 102 and the lower ends of the back support portions 103*a* and 103*b* of the hollow at the boundary between the coupling front face 13 and the end front face 14 (FIG. 13), and the distance between the front face plates 102 of the left and right divided ends 12*b* of the central front face 12 at which the lower end of the front face plate 102 most projects forward and the lower ends of the back support portions 103*a* and 103*b* (FIG. 15). The outer end faces of the left and right integrally molded portions 101 are formed with a shaft hole 25*a*' of the first bracket 25*a* disposed outside, a laterally L-shaped opening 103*b*' and a rectangular opening 103*a*' formed above the opening 103*b*' as shown in FIG. 16 to ensure the rigidity and strength of the ends of the cylindrical back support portions 103*a* and 103*b*, and other portions have necessary thickness and closed.

The sheet metal portion 105 is made of rectangular divided central portion 12*a* of the central front face 12, and as show in FIGS. 2, 3 and 17 to 20, the sheet metal portion 105 includes the front face plate 106 obtained from one sheet metal, a sheet metal which is integrally formed on the back face of the front face plate 106 by welding, and the back support member 107 made of molded product. The back support member 107 includes a first back support member 107*a* made of flat trapezoidal sheet metal welded in the inclined manner from the upper end edge of the blade device 10 to the upper end edge of the cylindrical first back support portion 103*a* formed on an upper portion of the integrally molded portion 101 as viewed from back of the blade device 10 shown in FIG. 3, a second back support member 107*b* which connects the cylindrical upper back support portions 103*a* of the pair of left and right integrally molded portions 101 with the central front face 12 interposed therebetween by welding, a third back support member 107*c* made of sheet metal which closes a space between the first back support portion 103*a* and the second back support portion 103*b* disposed below the first back support portion 103*a* by welding over the left and right ends of the blade 11, and a fourth back support member 107*d* which connects the left and right cylindrical second back support portions 103*b* to each other by welding.

Figure 17:
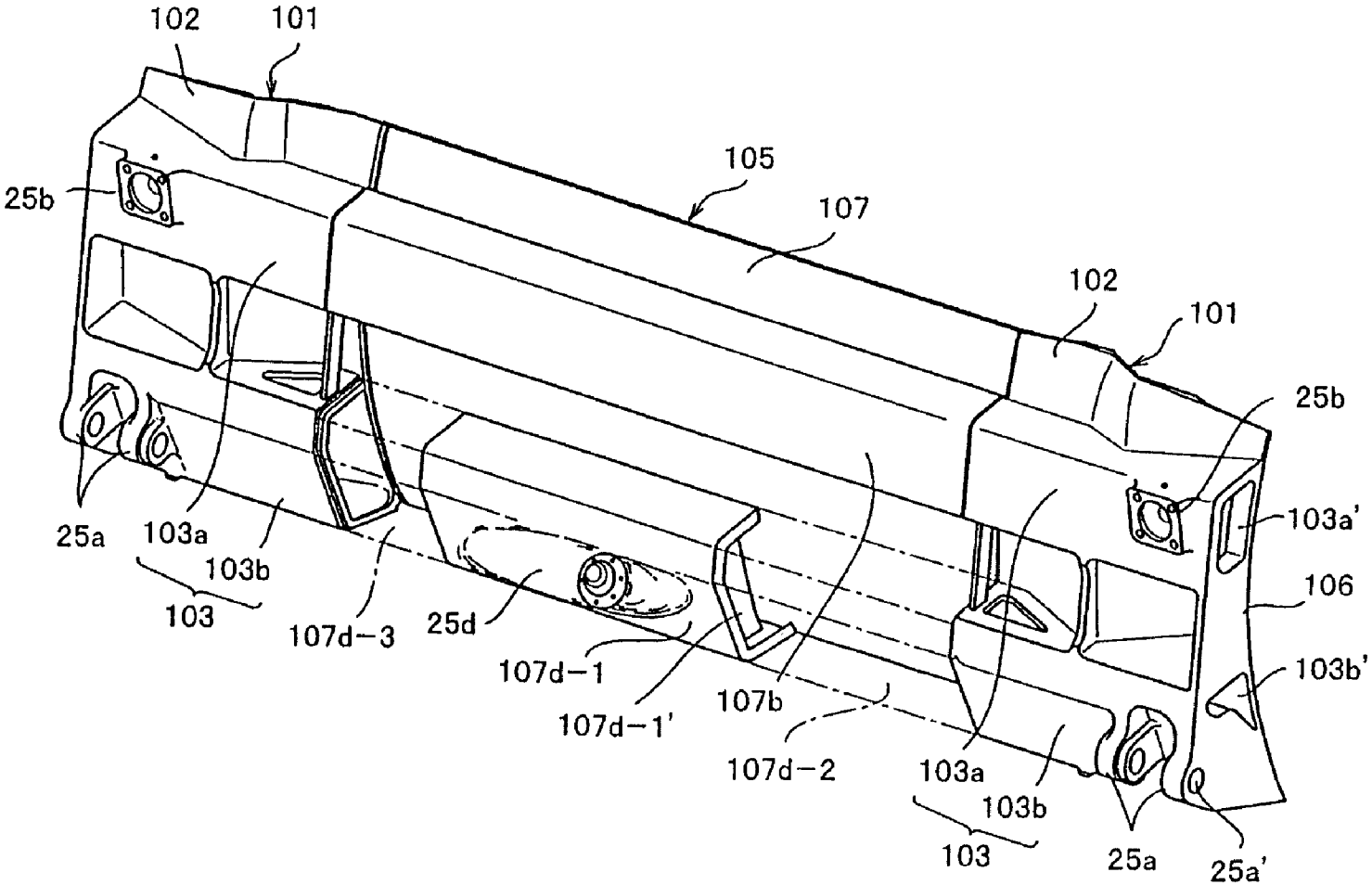
FIG. 17 is a perspective view of an entire blade device as viewed from the back face side and diagonally back side.
Figure 18:
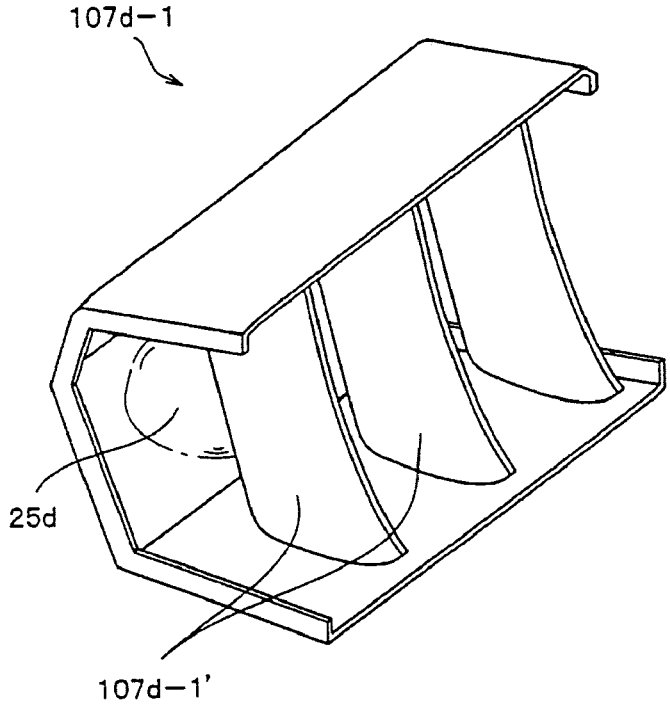
FIG. 18 is a perspective view of a back support member of a sheet metal portion as viewed from left and diagonally front.
Figure 19:
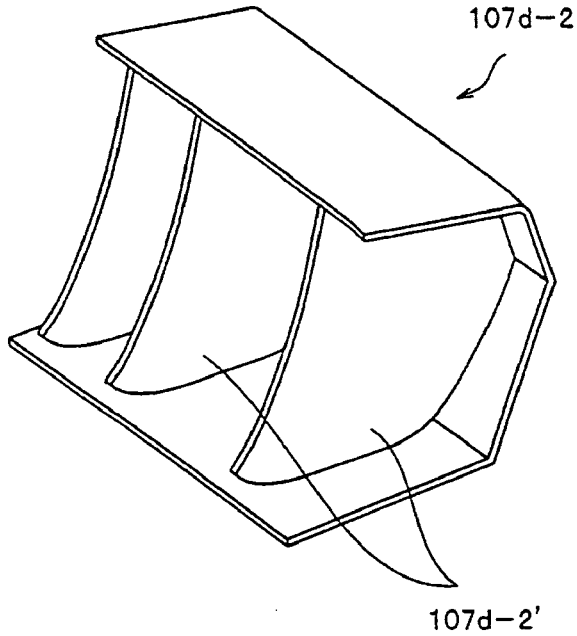
FIG. 19 is a perspective view of a portion of another back support member of the sheet metal portion as viewed from front.
Figure 20:
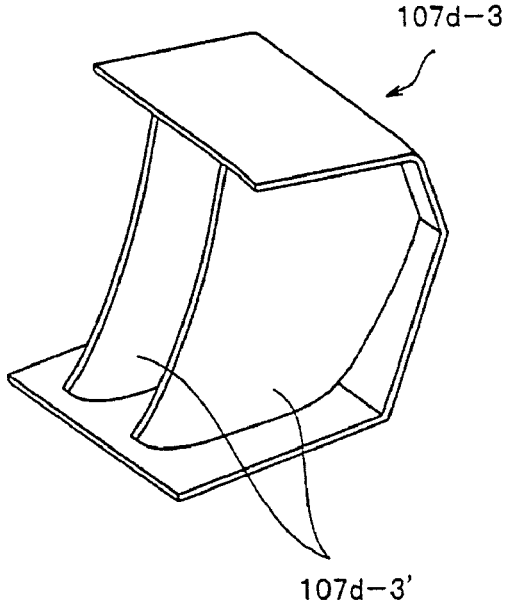
FIG. 20 is a perspective view of a portion of another back support member of the sheet metal portion as viewed from front.

The first and third back support members 107*a* and 107*c* are made of sheet metal, and a plurality of reinforcing ribs (not shown) are interposed between the front face plate 106 and the first and third back support members 107*a* and 107*c*. The second back support member 107*b* comprises a single molded product having a laterally thin and long U-shaped cross section. As shown in FIGS. 17 to 20, the fourth back support member 107*d* comprises three divided molded products, i.e., a left divided member 107*d*-2, a central divided member 107*d*-1 and a right divided member 107*d*-3. The central divided member 107*d*-1 is a block body having a U-shaped cross section. As shown in FIGS. 17 and 18, a fourth bracket 25*d* which supports one end of the strut arm 7 is integrally molded on a central portion of the central divided member 107*d*-1 such as to project rearward, and a plurality of reinforcing ribs 107*d*-1' are simultaneously molded between the inner walls thereof. End divided members 107*d*-2 and 107*d*-3 disposed on the left and right sides also comprise block bodies having U-shaped cross section having a plurality of reinforcing ribs 107*d*-2' and 107*d*-3' between the inner walls like the central divided member 107*d*-1.

In the embodiment, the entire blade width W including the central front face 12, the left and right coupling front faces 13 and the left and right end front faces 14 of the blade device 10 as viewed from above is set to a size of 2.3 to 3.0 times of an inner width WO of the working machine body disposed inside the left and right driving devices. If the entire blade width W and the inner width WO of the working machine body are set in this manner, the longitudinal and lateral balance of the entire working machine is stabilized at the time of excavation and soil transportation, the operability of the entire working machine is improved and as a result, the excavation performance is sufficiently exhibited, and waste of fuel can be prevented.

The blade device 10 of the embodiment having the above-described constituent members is assembled in the following manner. First, inner end faces of the front face plates of the pair of left and right integrally molded portions 101 and left and right ends of the rectangular front face plate 106 of the central front face 12 are butted against each other, and these three members are integrally formed together by welding. Since the welding line is on the vertical line as viewed from front, if the members are positioned, they can easily be welded by the welding robot. Before the welding, side plates 108 having longitudinal widths extending forward from the curved front end edge of the outer end face are integrally formed on the outer end faces of the integrally molded portions 101. The side plates 108 hold the transported soil to prevent the soil from dropping from side of the blade, and reinforces the end front face 14.

The various back support members 107 are integrally assembled on the back face of the blade 11 manufactured in this manner by welding. After the assembling operation is completed, falcated third bracket 25*c* is fixed by welding astride the left and right divided members 107*d*-1 and 107*d*-3 of the third back support member 107*c* and the fourth back support member 107*d* to support the piston rod ends of the two pairs of left and right (hydraulic) lift cylinders 6 shown in FIGS. 3 and 4. The first to third cutters 15 to 17 are fixed along the lower ends of the central front face 12, the coupling front faces 13 and the end front faces 14 of the blade 11 of the embodiment assembled in this manner in the same manner as that of the conventional technique, and the blade device 10 of the invention is completed. The first cutter 15 is flat and straight in shape along the lower end of the central front face 12. Thus, it is unnecessary to exchange the blade 11 whenever the operations such as excavation and soil transportation and ground making is switched, the first cutter 15 can effectively be used for the excavation and soil transportation and ground making operations, and these operations can smoothly and efficiently be carried out.

In the blade device 10 completed in this manner, the front face plate 106 of the central front face 12, the end triangular portion of the central front face 12, the coupling front faces 13 and the end front faces 14 can be assembled at a dash only by integrally forming, by welding, the integrally molded portions 101 integrally having the triangular divided end 12*b* of the central front face 12, the coupling front faces 13 and the end front faces 14. At that time, since the triangular divided end 12*b*, the coupling front faces 13 and the end front faces 14 are integrally molded with the first and second back support portions 103*a*, 103*b* and the first and second brackets 25*a* and 25*b*, other special machining or assembling is unnecessary, the welding robot is employed and with this, the assembling performance of the entire blade is improved, and the assembling time is largely shortened.

In the integrally molded portions 101, the bent boundary between the coupling front face 13 and the end front face 14 at which the front face plate 102 and the back face portion 103 approach most approaches to the minimum value, the front face plate 102 and the second back support portion 103*b* are made as a continuous solid structure in a portion where rigidity and strength are required, especially at a molding region of the first bracket 25*a* which pivotally supports the lift frame 3, and a portion between the front face plate 102 in the other back face region and the back support portions 103*a* and 103*b* is made as a hollow structure. Therefore, it is possible to minimize the longitudinal width of the blade device 10 and the weight thereof can also be reduced. Especially, the first and second brackets 25*a* and 25*b* are integrally molded on the first and second back support portions 103*a* and 103*b*, the base ends are pulled into the back face portion 103, the rearward projecting amount can be reduced and thus, the longitudinal maximum depth of the blade 11 can further be reduced. A hollow structure using sheet metal is employed in a region of the back support member 107 of the sheet metal portion 105 of the central front face 12 where high rigidity and strength are not required, the hollow structure having the reinforcing ribs 107*d*-1', 107*d*-2' and 107*d*-3' made of molded product is employed in a region thereof where high rigidity and strength are required. Therefore, it is possible to secure the rigidity and strength required in the entire blade in each region, and to largely reduce the blade device in size and weight. Since the assemblability is improved, the blade device is reduced in size and weight as described above, it is possible to prevent the producing cost from increasing.

According to the blade device 10 of the present invention, since the same blade front face shape as that of the patent document 3, the front face of the coupling front face 13 of the embodiment also has a function for smoothly merging soil moved from front faces of both the central front face 12 and the end front face 14 at the time of excavation and soil transportation. The end front face 14 has a function for reliably holding soil during the excavation and soil transportation so that the soil does not overflow outside from the side of the blade. Since the coupling front face 13 and the end front face 14 raises and holds soil along the front faces of the blades, the loss of the amount of soil is reduced, the resistance of soil trying to flow toward the central front face 12 from the end front face 14 is reduced, and the amount of soil deposited on the front face of the blade of the central front face 12 can largely be increased.

Figure 3:
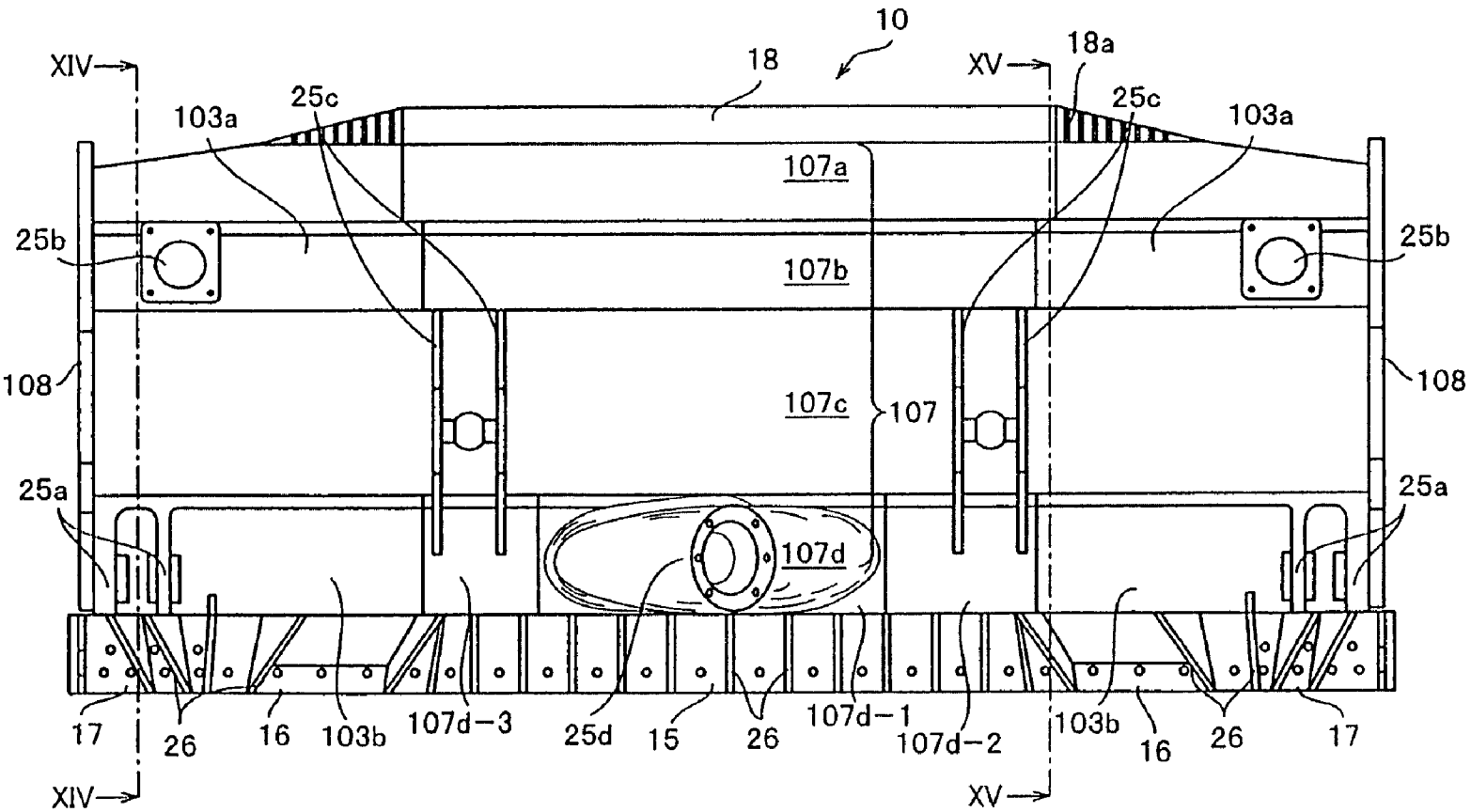
FIG. 3 is a rear view of the blade.

The first cutter 15, the second cutter 16 and the third cutter 17 are made of tough material which has excellent wear resistance and which is not easily damaged, e.g., boron steel. The first cutter 15, the second cutter 16 and the third cutter 17 are disposed such that the first cutter 15 excavates prior to the second and third cutters 16 and 17. Since the excavation by the first cutter 15 first breaks up the ground around the first cutter 15, the substantially excavation force required for the second and third cutters 16 and 17 is made smaller than the excavation force of the first cutter 15, and the excavation amount becomes smaller than that of the first cutter 15 at the same time. As shown in FIG. 3, a plurality of vertical plate ribs 26 which reinforce the cutters 15 to 17 extend in the longitudinal direction at the portion of the lower end plate of the blade 11 corresponding to the first to third cutters 15 to 17. Front ends of the vertical plate ribs 26 and the rear faces of the cutters 15 to 17 are threadedly engaged with each other.

Figure 21:
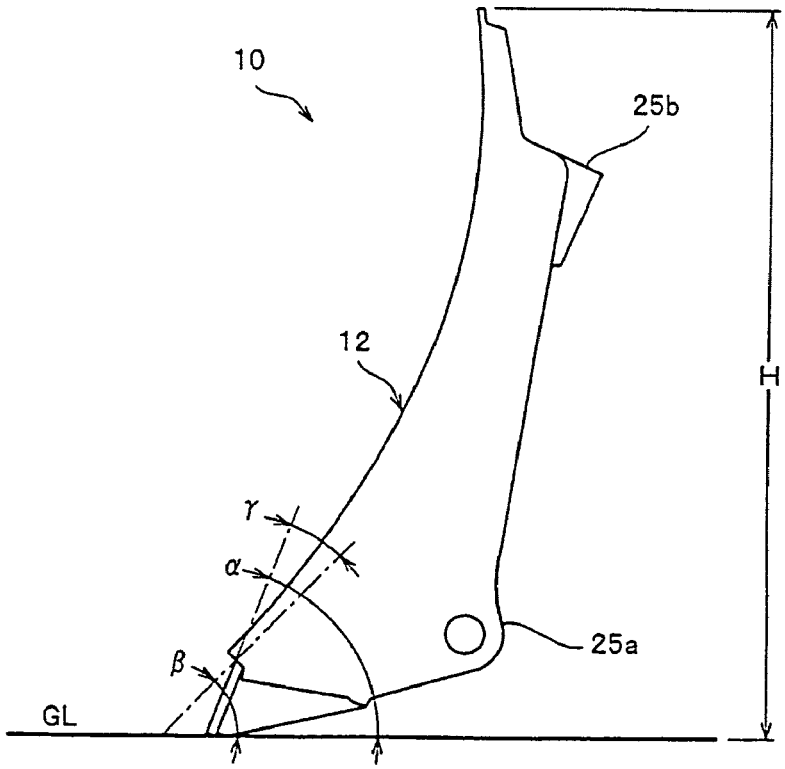
FIG. 21 is an explanatory diagram showing a relation a crossing angle between a curved face and the cutter in a front face of the blade portion.

In each of the blade portions 12 to 14, the blade front face of at least the central front face 12 is inclined rearward than the front face of the first cutter 15. However, in this embodiment, as shown in FIG. 21, the retraction angle $\gamma$ which is a difference between an angle (tip angle) a formed between the ground surface and the front face of the first cutter 15 and an angle (excavation angle) $\beta$ formed between the ground surface and the lower end face of the blade of the central front face 12 is set to 10° as in the patent document 3, the rearward inclination of the entire blade is reduced, and soil loaded on the blade adheres to the front face when soil is discharged and soil is less prone to slip and drop. Hence, in this embodiment, the tip angle $\alpha$, the blade height and the radius of curvature of the entire face of the blade described in the patent document 3 are not changed, and the retraction angle $\gamma$ is set to 0°. As a result, as shown in FIG. 22, it was found that the rearward inclination of the entire blade was reduced, and the amount of soil transportation was largely reduced.

Figure 22:
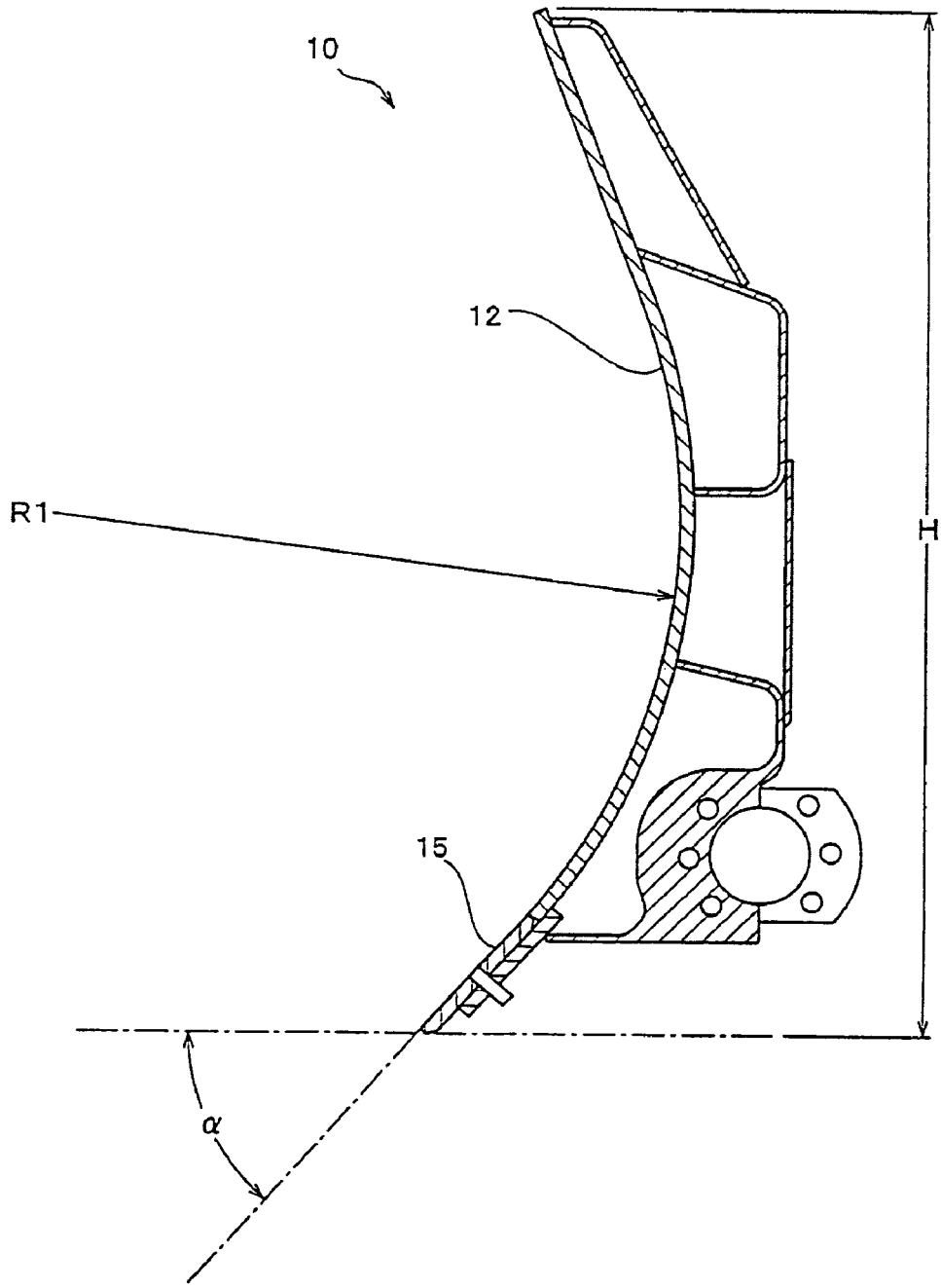
FIG. 22 is a vertical cross-sectional view showing a rearward inclined position of the blade when an arc surface having a small diameter is formed at the same height and same excavation angle (tip angle)
Figure 23:
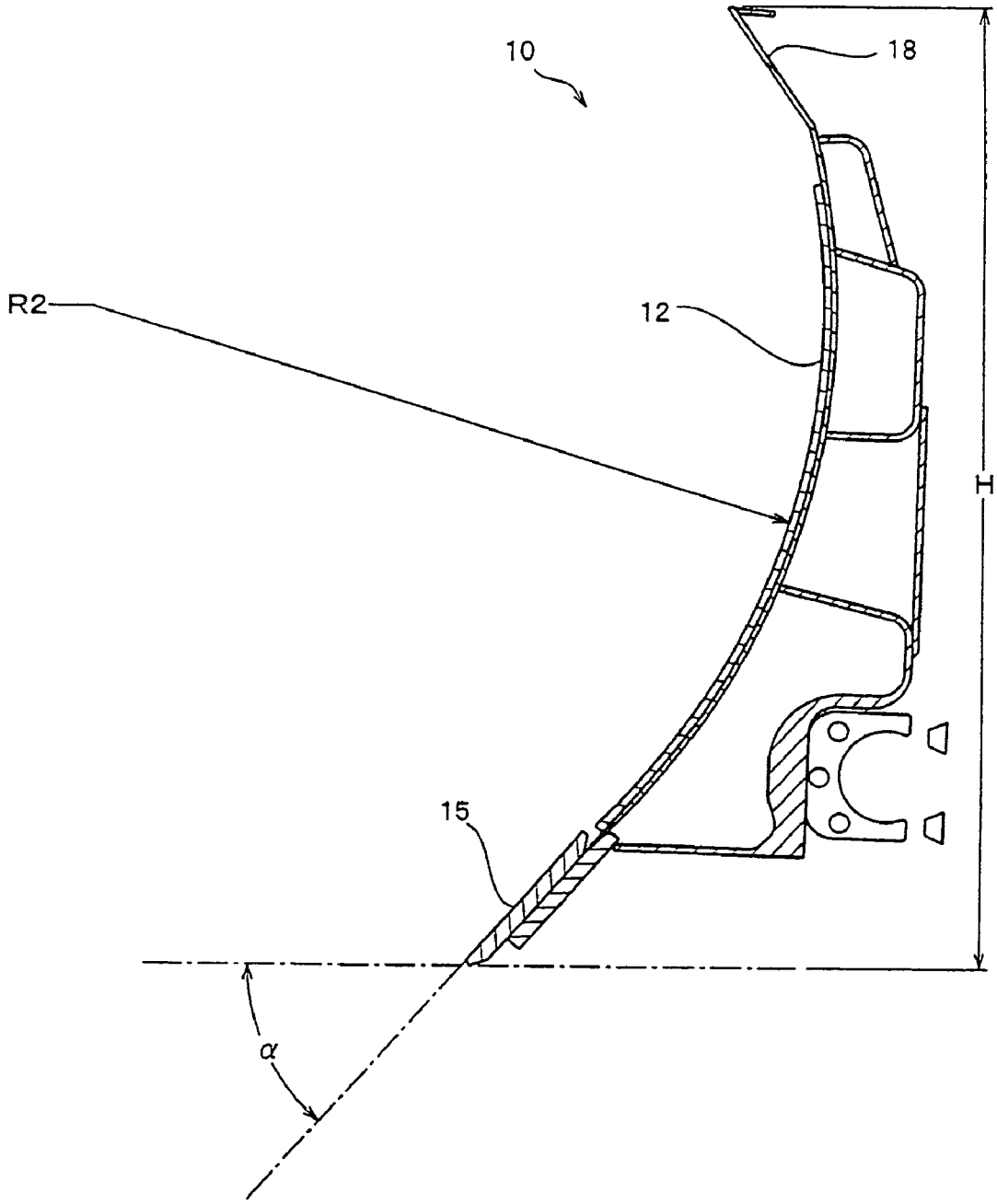
FIG. 23 is a vertical cross-sectional view showing a rearward inclined position of the blade when an arc surface having a large diameter is formed at the same height and same excavation angle (tip angle)

FIG. 22 shows the rearwardly inclined position of the blade when the first cutter 15 is extended in the tangent direction of the lower end of the front face arc face of the central front face 12 having the same radius of curvature R1 as that of the conventional technique. FIG. 23 shows a position of the blade 11 of the embodiment, the retraction angle $\gamma$ of the first cutter 15 is 0° and it is fixed to the lower end of the central front face 12 like FIG. 22, but the radius of curvature R2 of the front face arc face of the central front face 12 is set larger than the radius of curvature R1 of the arc face shown in FIG. 22. In both the drawings, the height H from the tip of the first cutter 15 to the upper end of the blade is the same height. As can be understood from these drawings, even if the tip angle $\alpha$ is the same, the blade 11 having the larger radius of curvature R2 of the arc face shown in FIG. 23 inclined rearwardly larger than the blade 11 having the smaller radius of curvature shown in FIG. 22. As a result, the amount of soil transportation on the blade is increased, and when soil is discharged also, soil smoothly drops from the entire face of the blade, and soil does not adhere to and remain on the entire face of the blade.

Figure 24:
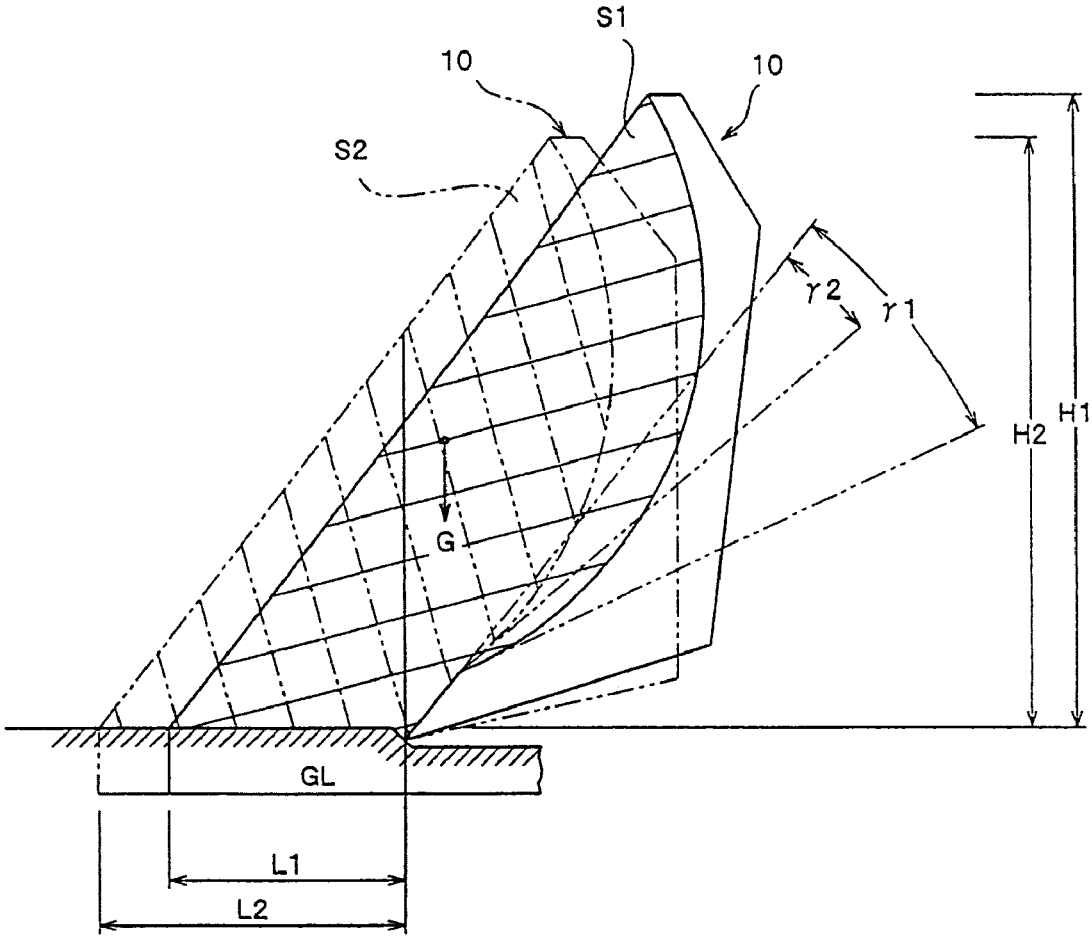
FIG. 24 is an explanatory diagram showing a relation of soil deposited in front of the blade by a normal position and a rearward inclined position of the blade at the time of excavation and soil transportation.

In order to reduce the slip resistance between the ground and soil deposited on the ground surface in front of the blade at the time of soil transportation operation, the area of soil, which comes into contact with the ground surface, should be reduced. As shown with the solid line and phantom line in FIG. 24, the inclination angle (angle of rest) of the front face of the deposited soil, when soil is carried out by the blade, is constant. To reduce the area of soil which comes into contact with the ground surface, the tip end of soil is brought closer to the tip of the blade device 10 as much as possible such that the distance between the tip and the tip end of soil deposited on the ground surface becomes L1 from L2, and the hatch region made by the slant lines inclining left and downward in the solid line and phantom line in the drawing is shifted from S2 to S1. FIG. 24 is a schematic explanatory diagram showing a variation in slip resistance between the ground surface and soil deposited on the ground surface in front of the blade based on the blade position. In the drawing, the solid line shows the position of the soil transportation of the blade device 10 by the present invention, and the phantom line shows the soil transportation position of a normal blade. Here, the front face curved face of both the blade is the same and the tip angle $\alpha$ (=$\beta$) is constant.

If the tip end of soil deposited on the ground is simply brought close to the tip, since the front face of soil deposited on the ground surface always forms the same inclination angle, if the tip angle $\alpha$ and the retraction angle $\gamma$ (=0°) are made constant, the height of the blade becomes low necessarily, and the amount of held soil deposited on the blade is also reduced. To make the held amount the same as that of the normal case, since the blade width is constant, it is necessary that the regions S1 and S2 shown with the right inclination hatch by the solid line and phantom line are the same.

As a result, in order to reduce the soil transportation resistance the to make the excavation amount and the soil transportation amount are the same as those of the normal time, the retraction angle $\gamma$ is set to 0° as shown in FIG. 23 and the radius of curvature of the entire face of the blade is set to the radius of curvature R2 which is larger than the conventional radius of curvature R1 shown in FIG. 22, and the blade device 10 is inclined rearward. However, the retraction angle $\gamma$ which is the difference between the tip angle $\alpha$ and the excavation angle $\beta$ is set to a retraction angle which is larger than the normal retraction angle $\gamma$, and the blade device 10 is inclined rearward. However, if the retraction angle $\gamma$ is made excessively large, the overflowing amount of soil rearward of the blade is increased and the deposited soil is less prone to drop from the blade device 10 when soil is discharged. Thus, it is preferable that the retraction angle $\gamma$ is 15° or less as described above.

The ground contact length L1 of soil deposited on the blade device 10 in this embodiment is reduced by about 10% as compared with the ground contact length L2 of normal soil deposited on the ground in front of the tip, and the deposited soil amount on the ground is largely reduced. On the other hand, the amount of soil in front of the blade portions 12 to 14 can be loaded on the front face of the blade during excavation and soil transportation, and a so-called holding amount is increased. As a result, the soil transportation resistance can largely be reduced, the horsepower consumption per a traction force can largely be reduced and excellent fuel efficiency can be realized.

In the embodiment, since the retraction angle γ is the smallest value, i.e., 0°. Therefore, the mounting operation of the cutter is facilitated, and when the curved face is the same as that of the conventional technique and the tip angle α is not changed, the rising of the blade 11 becomes excessively large and the soil transportation amount slips and drops abruptly. Hence, the radius of curvature of the arc face of the front face of the blade is increased to R2 which is larger than the normal R1, the rearward inclined position of the blade is increased, the soil transportation resistance is reduced, and the excavation amount and the soil transportation amount could be increased to the same amounts as those of the normal time or greater.

Further, since a large amount of soil can be loaded on the front face of the blade 11, excellent balance of the ground contact pressure in the longitudinal direction of the vehicle is obtained, power loss such as shoe slip is reduced, and high traction force is obtained. In the embodiment, the trapezoidal sheet metal material 18 is inclined forward and added on the arc face of the upper end of the blade 11 from the end thereof, and the large number of lattices 18*a* arranged in the lateral direction are formed on both ends thereof. With this, remaining soil of soil deposited on the front face of the blade overflows laterally from the gap between the lattices 18*a* formed on left and right sides of the sheet metal material 18, it is possible to prevent soil from overflow rearward beyond the upper ends of the blade portions 12 to 14, and the amount of soil loaded on the upper end of the blade is appropriately maintained. The excavated soil does not come into contact with the front face of the blade under pressure, soil separates excellently when soil is discharged, and the soil discharge performance is improved. The tip angle α formed between the ground surface and the front face when the tips of the cutters 15 to 17 are on the ground surface is preferably in a range of about 40° to 55°. With this, the minimum excavation and soil transportation energy amount and the maximum soil amount can effectively be obtained.

The traction force and the amount of soil per traction force by the blade of the invention are increased as compared with the conventional semi-U type blade or straight blade. According to the blade of the invention, the excavation resistance is reduced as compared with the conventional blade, and the soil transportation resistance is also reduced. Thus, the horsepower consumption at the time of excavation and soil transportation of the blade of the invention is less than that at the time of the excavation and soil transportation of the conventional blade. From the above reasons, the blade of the invention can realize a desired dozer operation efficiently with small traction force and excavation force within a shorter time than that of the conventional operation time.

As apparent from the above explanation, the blade of the blade device of the present invention can easily determine the shape having the highest excavation efficiency, and when turning while pushing operations, soil does not flow out from the blade. When the molded body and the sheet metal are effectively combined, the blade structure is simplified, the assembling operation is facilitated, the welding operation is improved, and the blade device is reduced in weight and size. Since it has the blade structure described in the patent document 3, like the blade device described in the patent document 3, the resistance force against the traction force is reduced, and the amount of soil per traction force is largely increased necessarily. The horsepower consumption during the excavation and soil transportation can largely be reduced at the same time, the maximum excavation and soil transportation amount can be obtained with the minimum energy amount within short time, and the fuel efficiency of the working machine is largely improved, and the cost can be reduced.

The invention claimed is:

1. A blade device mountable on various working machines, wherein a blade includes a central front face, and left and right end front faces continuously provided through coupling front faces which are bent and continuously provided on left and right ends of the blade, a lower end of the central front face has a blade width W1 which intersects orthogonally with an excavation direction and extends laterally, and the central front face is further provided at the lower end of the central front face with a first cutter, the coupling front faces and the end front faces are provided at lower ends of the coupling front face and lower ends of the end front faces, respectively, with second and third cutters, a cross line between each of the coupling front faces and each of the end front faces and an intersection of each tip of the second and third cutters are located rearward of a tip of the first cutter as viewed from above, respective front faces of the central front face, the coupling front faces and the end front faces are concavely curved faces which are continuous from upper ends to lower ends, and when the blade width of the central front face is defined as W1, a distance between an extension of the first cutter and the intersection of each tip of the second and third cutters is defined as Wt, and a backward-bending angle between the tip of the first cutter and the second cutter is defined as δ, the distance Wt and the backward-bending angle δ simultaneously satisfy following expressions (I) and (II):

$$Wt>0.65\times(W1/10) \quad \text{(I)}$$

$$14°<\delta<30° \quad \text{(II)}.$$

2. The blade device according to claim 1, wherein a crossing angle θ between extensions of each cutter of the central front face and each of the end front faces is set larger than 0° and smaller than 25°.

3. The blade device according to claim 1, wherein the blade is made of sheet metal entirely.

4. The blade device according to claim 1, wherein a molded body is used as a portion of the blade.

5. The blade device according to claim 4, wherein a connecting line between end faces of the molded body and the sheet metal is on a horizontal straight line or vertical line as viewed from front.

6. A working machine having the blade device mounted according to claim 1.

7. A blade device for earthwork mountable on various working machines, wherein a blade includes a central front face, coupling front faces which are continuously provided so as to be bent from left and right ends of the blade rearward in an excavation direction, and left and right end front faces further continuously provided on the coupling front faces so as to project in parallel to or forward of an extension of the central front face, a lower end of the central front face has a blade width W1 which intersects orthogonally with the excavation direction and extends laterally, and the central front face is further provided at the lower end of the central front face with a first cutter, the coupling front faces and the end front faces are provided at lower ends of the coupling front faces and lower ends of the end front faces, respectively, with second and third cutters having blade widths W2 and W3, a cross line between each of the coupling front faces and each of the end front faces is located inside a pair of left and right bracket devices in a lateral direction as viewed from above of the blade device, the bracket devices being provided on a back face of the blade device as mounting portions of lift frames for connecting to the working machine, and a value of a ratio of the blade width W3 of each of the third cutters to the blade width W2 of each of the second cutters is set larger than 0.5 and smaller than 2.

8. The blade device according to claim 7, wherein the value of the ratio is 0.7 or larger and 1.3 or smaller.

9. The blade device according to claim 7, wherein the blade width W1 of the lower end of the central front face is 0.4 to 0.9 times of a length between the pair of left and right bracket devices, and a backward-bending angle δ of each cutter of the central front face and each of the coupling front faces is set 14° or larger and 30° or smaller.

* * * * *